US011085238B1

(12) United States Patent
Bancroft

(10) Patent No.: US 11,085,238 B1
(45) Date of Patent: Aug. 10, 2021

(54) SAFETY LADDER SUPPORT FOR USE WITH PARAPET ROOFS AND TO PROTECT GUTTERS ON THE ROOF DURING A CONSTRUCTION PROJECT

(71) Applicant: Russell N. Bancroft, Simi Valley, CA (US)

(72) Inventor: Russell N. Bancroft, Simi Valley, CA (US)

( * ) Notice: Subject to any disclaimer, the term of this patent is extended or adjusted under 35 U.S.C. 154(b) by 0 days.

(21) Appl. No.: 16/746,244

(22) Filed: Jan. 17, 2020

(51) Int. Cl.

| | |
|---|---|
| ***E06C 7/48*** | (2006.01) |
| *E06C 7/18* | (2006.01) |
| *E06C 7/16* | (2006.01) |
| *E06C 1/34* | (2006.01) |

(52) U.S. Cl.
CPC ..... *E06C 7/48* (2013.01); *E06C 7/486* (2013.01); *E06C 7/488* (2013.01); *E06C 1/345* (2013.01); *E06C 7/16* (2013.01); *E06C 7/188* (2013.01); *E06C 7/482* (2013.01)

(58) Field of Classification Search
CPC . E06C 7/48; E06C 7/486; E06C 7/488; E06C 1/34; E06C 7/16; E06C 7/188; E06C 7/482; E06C 7/484; E06C 1/345; E06C 1/36; E06C 7/50; E04D 13/076
See application file for complete search history.

(56) References Cited

U.S. PATENT DOCUMENTS

| | | | | | |
|---|---|---|---|---|---|
| 1,470,489 | A * | 10/1923 | Schuh | E06C 1/345 | 248/694 |
| 1,478,823 | A * | 12/1923 | Gauss | E06C 7/48 | 182/214 |
| 3,779,344 | A * | 12/1973 | Rister | E06C 7/48 | 182/214 |
| 3,910,380 | A * | 10/1975 | Nameche | E06C 1/34 | 182/206 |
| 4,102,433 | A * | 7/1978 | Van Valkenburgh | E06C 1/12 | 182/164 |
| 4,643,275 | A * | 2/1987 | LeBlanc | E06C 7/48 | 182/107 |
| 4,813,515 | A * | 3/1989 | Wigington | E04D 13/064 | 182/214 |
| 4,823,912 | A * | 4/1989 | Gould | E06C 7/484 | 182/107 |
| 4,901,818 | A * | 2/1990 | Schmitt | E06C 7/081 | 182/117 |
| 5,419,409 | A * | 5/1995 | Corulla | E06C 7/14 | 182/129 |
| 5,497,848 | A * | 3/1996 | Travis | E06C 7/486 | 182/107 |
| 5,664,643 | A * | 9/1997 | Taylor, Jr. | E06C 7/48 | 182/107 |
| 5,738,185 | A * | 4/1998 | Sears | E06C 7/12 | 182/102 |

(Continued)

*Primary Examiner* — Patrick D Hawn
*Assistant Examiner* — Taylor L Morris

(57) ABSTRACT

A safety ladder device supported by a worker to secure an extension ladder used by a worker to climb onto a roof to make repairs. The present invention is primarily used for roof repair construction on a parapet roof. The invention includes a wide section and a narrow section, one of which is hammered into a top wall of the parapet roof and extends forward off the roof to retain the extension ladder in a secure manner to prevent the ladder moving side-to-side or falling away.

5 Claims, 23 Drawing Sheets

(56) References Cited

U.S. PATENT DOCUMENTS 5,775,465 A * 7/1998 Vossler ..... E06C 7/48 182/107
5,862,881 A * 1/1999 O'Brien ..... E04G 1/30 182/117
5,992,564 A * 11/1999 Kirkpatrick ..... E06C 7/48 182/117
6,019,191 A 2/2000 Flores
6,109,392 A * 8/2000 Merrick ..... E06C 7/16 182/121
6,244,551 B1 * 6/2001 Fletcher ..... E06C 7/486 248/238
6,513,625 B1 * 2/2003 Gaskins ..... E04D 15/00 182/107
6,533,070 B1 * 3/2003 Elrod ..... E06C 1/345 182/103
6,578,665 B1 * 6/2003 DeBaca ..... E06C 1/34 182/107
6,578,666 B1 * 6/2003 Miller ..... B60R 3/007 182/106
6,722,469 B1 4/2004 Weger, Jr.
6,786,300 B1 * 9/2004 Bonifacini ..... E06C 7/165 182/120
6,837,338 B2 1/2005 Grover
7,726,445 B2 * 6/2010 Parnell ..... E04G 1/38 182/82
7,950,497 B2 5/2011 Horton
8,235,175 B1 * 8/2012 Feldhaus ..... E06C 7/486 182/214
8,783,415 B2 * 7/2014 Bancroft ..... E06C 7/188 182/107
9,051,746 B2 * 6/2015 Rogers ..... E04G 5/08
9,593,532 B2 4/2017 Dehoff et al.
9,777,535 B1 * 10/2017 Stentiford, Sr. ..... E06C 7/084
2002/0046543 A1 * 4/2002 Neuleib ..... E06C 1/345 52/749.12
2004/0089501 A1 * 5/2004 Hockensmith ..... E06C 7/48 182/107
2004/0140409 A1 * 7/2004 Radda ..... E06C 7/16 248/238
2005/0045421 A1 3/2005 Gaines
2005/0145707 A1 * 7/2005 Leni ..... A63C 5/06 238/14
2005/0224287 A1 * 10/2005 LaBrash ..... E04G 5/10 182/84
2007/0278040 A1 12/2007 Rager
2009/0000868 A1 1/2009 Gaines
2010/0116589 A1 5/2010 Mathieson
2012/0080263 A1 * 4/2012 Lee ..... E06C 1/345 182/8
2013/0233993 A1 * 9/2013 Striepling ..... E06C 7/486 248/309.1
2014/0262605 A1 9/2014 Copp
2015/0259979 A1 * 9/2015 Abe ..... E06C 7/48 211/153
2017/0058605 A1 3/2017 Napolitano
2017/0356245 A1 12/2017 Surdo
2018/0002982 A1 * 1/2018 Dressel ..... E06C 9/06
2018/0187486 A1 * 7/2018 Ford ..... E06C 1/32

* cited by examiner

SAFETY LADDER SUPPORT FOR USE WITH PARAPET ROOFS AND TO PROTECT GUTTERS ON THE ROOF DURING A CONSTRUCTION PROJECT

BACKGROUND OF THE INVENTION

1. Field of the Invention

The present invention relates to the field of safety devices used to secure a ladder against a roof of a structure and used by a person to safely climb onto a roof to perform a construction project on the roof and then to safely climb back onto the ladder to return to the ground after the roof construction project is completed.

2. Description of the Prior Art

The following prior art issued patents and published patent application are the closest prior art known to the inventor of the present invention:

1. United States Published Patent Application No. 2005/0045421 to Robert G. Gaines on Mar. 3, 2005 for "Ladder Securement Device";
2. United States Published Patent Application No. 2009/0000868 to Robert G. Gaines on Jan. 1, 2009 for "Ladder Docking Device";
3. U.S. Pat. No. 5,775,465 issued to Darby J. Vossler on Jul. 7, 1998 for Ladder Support";
4. U.S. Pat. No. 7,950,497 issued to Peter Donald Horton on May 31, 2011 for "Ladder Stabilising Device".
5. U.S. Pat. No. 6,019,191 issued to Leonard A. Flores on Feb. 1, 2000 for "Ladder Support System";
6. U.S. Pat. No. 6,722,469 issued to Kenneth F. Weger, Jr. on Apr. 20, 2004 for "Guard Plate and Safety Anchor";
7. U.S. Pat. No. 6,837,338 issued to Steven Barry Grover on Jan. 4, 2005 for "Ladder Safety Device";
8. United States Published Patent Application No. 2007/0278040 to Rick A. Rager on Dec. 6, 2007 for "Ladder Securing Plate";
9. United States Published Patent Application No. 2010/0116589 to Thomas R. Mathieson on May 13, 2010 for "Gutter Protection and Ladder Support Apparatus";
10. United States Published Patent Application No. 2014/0262605 to G. Michael Copp on Sep. 18, 2014 for "Bracket Assembly";
11, United States Published Patent Application No. 2017/0058605 to Michael J. Napolitano on Mar. 2, 2017 for "Roof Mounted Ladder Bracket System";
12. U.S. Pat. No. 9,593,532 issued to Clifford B. Dehoff et al. on Mar. 14, 2017 for "Ladder Mounting and Retaining System";
13. United States Published Patent Application No. 2017/0356245 to Leonardo Surdo on Dec. 14, 2017 for "Roof Mounted Ladder Safety Bracket",

SUMMARY OF THE INVENTION

The present invention is a safety ladder support device used by a worker to secure a ladder, which by way of example is eight feet, sixteen feet or twenty-four feet (hereafter collectively and individually referred to as "ladder") onto a roof so that the worker can make repairs to a roof or to participate in construction of the roof. While many types of a roof are used with the present invention, the most common roof on the structure where the present invention is used is a parapet roof.

It is also within the spirit and scope of the present invention to be use with shingle roofs and comparable roofs except tile roofs. The present invention is used to safely secure a ladder with its base on the ground and placed at an angle to the roof where it is retained by the safety ladder device. The ladder is safely secured by the safety ladder device. The ladder is a large ladder having a height selected from the group consisting of nine feet, twelve feet and eighteen feet or an extension ladder when in the fully extended condition extends to a height selected from the group consisting of eight feet, twelve feet, sixteen feet and twenty-four feet. The angle of slope of the ladder from the ground to the safety ladder device adjacent the front wall of the parapet roof which is seventy-five degrees, aligned with the front wall of the structure, requires a ground distance from the front wall of the structure (and aligned from the front wall of the parapet roof) to the base of the ladder of one-quarter the height of the ladder. For a ladder which is nine feet high, the ground distance from the front wall of the structure to the base of the ladder is two and a half feet. For a ladder which is twelve feet high, the ground distance from the front wall of the structure to the base of the ladder is three and a half feet. For a ladder which is eighteen feet high, the ground distance from the front wall of the structure to the base of the ladder is six feet. It will be appreciated that any height ladder, as long as it can meet the distance requirement of ground to front of ladder safety device, is within the spirit and scope of the present invention. This ground distance is equivalent to a slope angle of seventy-five degrees.

It is an object of the present invention to provide a device for safely retaining a ladder with its feet on a horizontal ground surface with the ladder set at an angle of seventy-five degrees relative to the parapet rooftop wall surface and front wall surface. The ladder angle is positioned to avoid damaging a gutter, if it exists, which is affixed adjacent the top wall surface and/or on the front wall surface adjacent the top parapet wall. In mot cases, the parapet roof does not require a gutter.

It is an object of the present invention to provide a one piece ladder and or an extension ladder (hereafter jointly referred to as an "extension ladder") which invention is an extension ladder safety apparatus which includes both a first wide section and a first narrow section.

The first wide section includes a first wide body including a top surface and a bottom surface, the top surface having a multiplicity of gripping members selected from the group consisting of diamond plate projections and Durbar plate projections thereon extending at spaced apart locations on the top surface. The first wide section further includes a back side edge with a hinge selected from a group consisting of a piano hinge and a pair of spaced apart door hinges. The piano hinge is defined as a hinge that has a thin pin joint that extends along the part to be moved. The present invention includes a first narrow section with a back side edge. When a piano hinge is used, a thin longitudinal housing is rotatably affixed to a first continuous plate affixed to the top surface and along the back edge of the first wide plate and also rotatably affixed to a second continuous plate affixed to the top surface and along the back edge of the narrow section. A longitudinal pin extends within the entire length of the longitudinal housing to enable the first wide section and the first narrow section to rotate relative to each other.

When a door hinge is used, the first wide section further includes a back side edge with a first gap to retain a first hinge bracket and a spaced apart second gap to retain a second hinge bracket, the first and second gap each extending from the top surface to the bottom surface.

Regardless of the hinge used, the first wide edge further includes a first side edge portion, a spaced apart second side edge portion, a front wide U-shaped portion with two laterally spaced apart forwardly extending arms including a first arm aligned along one side with the first side edge portion and a second arm aligned along an opposite side with the second edge portion. A front edge between the two arms, and a ladder securing opening extending from the top surface to the bottom surface and located adjacent to and separated from the front edge and at a location between the first side edge portion and the second side edge portion.

The wide section further includes at least one first affixing opening in the first wide body extending from the top surface to the bottom surface, and preferably a spaced apart second affixing opening in the first wide body extending from the top surface to the bottom surface.

It is a further object of the present invention to provide a ladder safety apparatus further including a narrow section having a second narrow body including a top surface and a bottom surface. The top surface includes a multiplicity of projections selected from the group consisting of diamond plate projections and Durbar plate projections thereon extending at spaced apart locations on the top surface. The narrow section further includes a back edge. A connection through a piano hinge has been described.

If a door hinge is used, then on the back edge a third gap to retain a third hinge bracket and a spaced apart fourth gap to retain a fourth hinge bracket. The third and fourth gaps each extend from the top surface to the bottom surface. The second narrow section further includes a third side edge portion, a spaced apart fourth side edge portion, a front wide U-shaped portion with two laterally spaced apart forwardly extending arms including a third arm aligned with one side aligned with the third side edge portion and a fourth arm aligned along an opposite side with the fourth edge portion and a front side portion between the two arms. A ladder securing opening extends from the top surface to the bottom surface and located adjacent to and separated from the front side portion edge and at a location between the third side edge portion and the fourth side edge portion. At least one third affixing opening in the second narrow body extends from the top surface to the bottom surface and preferably, a spaced apart fourth affixing opening in the second narrow body extends from the top surface to the bottom surface.

The narrow section further includes a back edge of the narrow section aligned with the back edge of the wide section, the first gap and first hinge bracket aligned with the fourth gap and the fourth hinge bracket, the second gap and second hinge bracket aligned with the third gap and the third hinge bracket. The first hinge bracket is rotatably connected to the fourth hinge bracket by a first connecting pin and the second hinge bracket is rotatably connected to the third hinge bracket by a second connecting pin, and the wide section is rotatably connected to the narrow section.

It is a significant object of the present invention to adapt the above described safety ladder support apparatus for use with a parapet roof having a wall with a top surface, a front surface and a rear surface and adapted for use with a ladder having a multiplicity of spaced apart steps and one end on a ground surface and tilted at an angle toward the parapet roof wall as previously described.

In a first embodiment, it is an object of the present invention to affix the wide section to the top surface of the parapet roof wall by at least one, and preferably a pair, of affixing members respectively hammered through a respective ladder securing opening. In this embodiment, the front surface and front arms extend in front of the front surface of the parapet roof wall. A ladder rests on the ground and is positioned at an angle and rests against the front surface between the two front arms of the wide section to prevent side-to-side movement of the extension ladder.

As additional security, for the first embodiment, it is a further object of the present invention to include a ladder step fastening member wrapped through the ladder securing opening and wrapped around at least one step of the ladder.

In the first embodiment, the narrow section is rotated ninety degrees and hangs downward relative to the parapet rooftop wall. The first and second hinge bracket connecting pins are located or the long pin of a piano hinge is located at a rear edge of the parapet roof wall at a location between the top surface and rear surface so that the narrow section hangs down adjacent the rear surface wall of the parapet roof wall and affixing members are respectively hammered through the third and fourth affixing openings in the narrow section and through the rear surface of the parapet roof wall.

In order to reduce the possibility of a worker slipping on the apparatus, it is an additional object of the present invention for the first wide section body to be made of gripping material selected from the group consisting of diamond plate aluminum also called aluminum tread plate, diamond plate steel also called steel tread plate, high density polyethylene with raised diamond gripping members, Durbar floor plate metal, Durbar floor plate ABS plastic and Durbar floor plate polyvinyl. In addition, the first narrow section body is also made of gripping material selected from the group consisting of diamond plate aluminum also called aluminum tread plate, diamond plate steel also called steel tread plate, high density polyethylene with raised diamond gripping members, Durbar floor plate metal, Durbar floor plate ABS plastic and Durbar floor plate polyvinyl.

To simplify the description, for each plate, diamond plate aluminum also called aluminum tread plate, diamond plate steel also called steel tread plate, high density polyethylene with either raised diamond gripping members or raised check cut gripping members, or Durbar floor plate metal are sometimes collectively and separately defined as a "metal or plastic plate with gripping members".

In a variation of the first embodiment, instead of letting the second narrow section hang down or having it nailed to the back of the back surface wall of the parapet roof wall, the second narrow section extends either in line with the first wide section or at a slight angle relative to the rear surface wall. A small extension ladder is set so that its feet rest on a horizontal interior roof surface and the small extension ladder is positioned against the rear wall between the third and fourth arms, and retained with a rope or chain wrapped around a step or rung of the ladder and the ladder securing opening in the second narrow section. Preferably, there are several wrappings around the ladder step or rung and the ladder securing opening. The worker then climbs up the small extension ladder and onto the top surface of the wide section and onto the extension ladder.

In a second embodiment, it is an object of the present invention to affix the narrow section to the top surface of the parapet roof wall by at least one, and preferably a pair of affixing members respectively hammered through a respective ladder securing opening into the parapet roof wall and through the parapet rooftop surface and extending forward of the front surface of the parapet roof wall with the ladder resting on the front/rear side and between the third arm and the fourth arms to prevent side-to side movement of the extension ladder.

As additional security for the second embodiment, it is a further object of the present invention to include a ladder step fastening member wrapped through the ladder securing opening and wrapped around at least one step of the extension ladder.

In the second embodiment, the wide section is rotated ninety degrees and hangs downward relative to the parapet rooftop wall. The third and fourth hinge bracket connecting pins are located or the long pin of a piano hinge is located at a rear edge of the parapet roof wall at a location between at the top surface and rear surface so that the wide section hangs down adjacent the rear surface wall of the parapet roof wall and affixing members are respectively hammered through the first and second affixing openings in the wide section and through the rear surface of the parapet roof wall.

In order to reduce the possibility of a worker slipping on the apparatus, it is an additional object of the present invention for the second narrow section body to be made of metal or plastic plate with gripping members.

In a variation of the second embodiment, instead of letting the first wide section hang down or be nailed to the back of the back surface wall of the parapet roof wall, the first wide section extends either in line with the second narrow section or at a slight angle relative to the rear surface wall. A small extension ladder is set so that its feet rest on a horizontal interior roof surface and the small extension ladder is positioned against the front wall between the first and second arms and retained with a rope or chain wrapped around a step or rung of the ladder and ladder securing opening in the wide section. Preferably, there are several wrappings around both the ladder step or rung and the ladder securing opening. The worker then climbs up the small extension ladder and onto the top surface of the narrow section and then onto the extension ladder.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
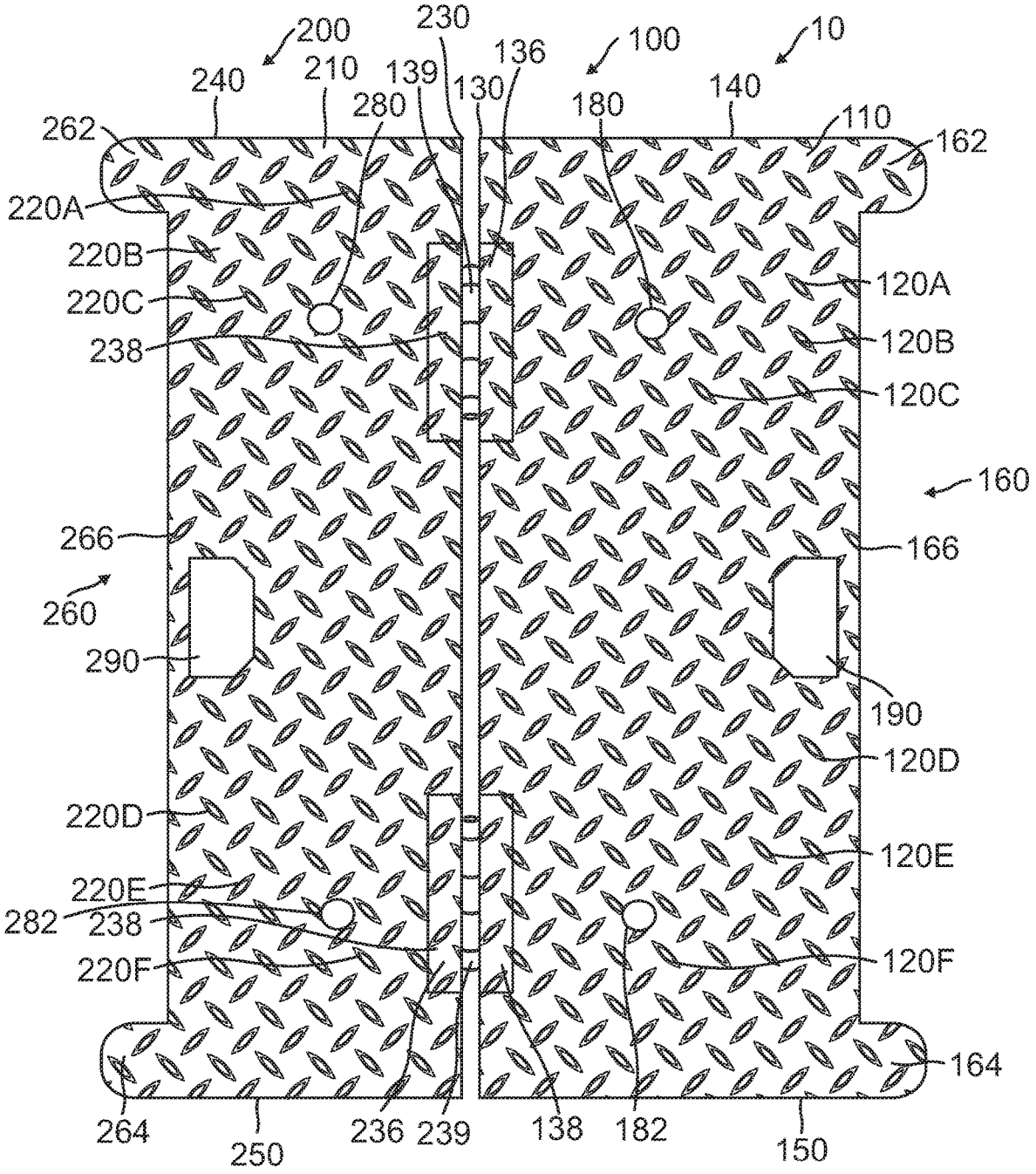
FIG. 1 is a top plan view of an embodiment of the present invention ladder safety support device in the unused condition, illustrating a pair of door hinges connecting the wide plate and the narrow pate, and raised diamond plate gripping surfaces.
Figure 2:
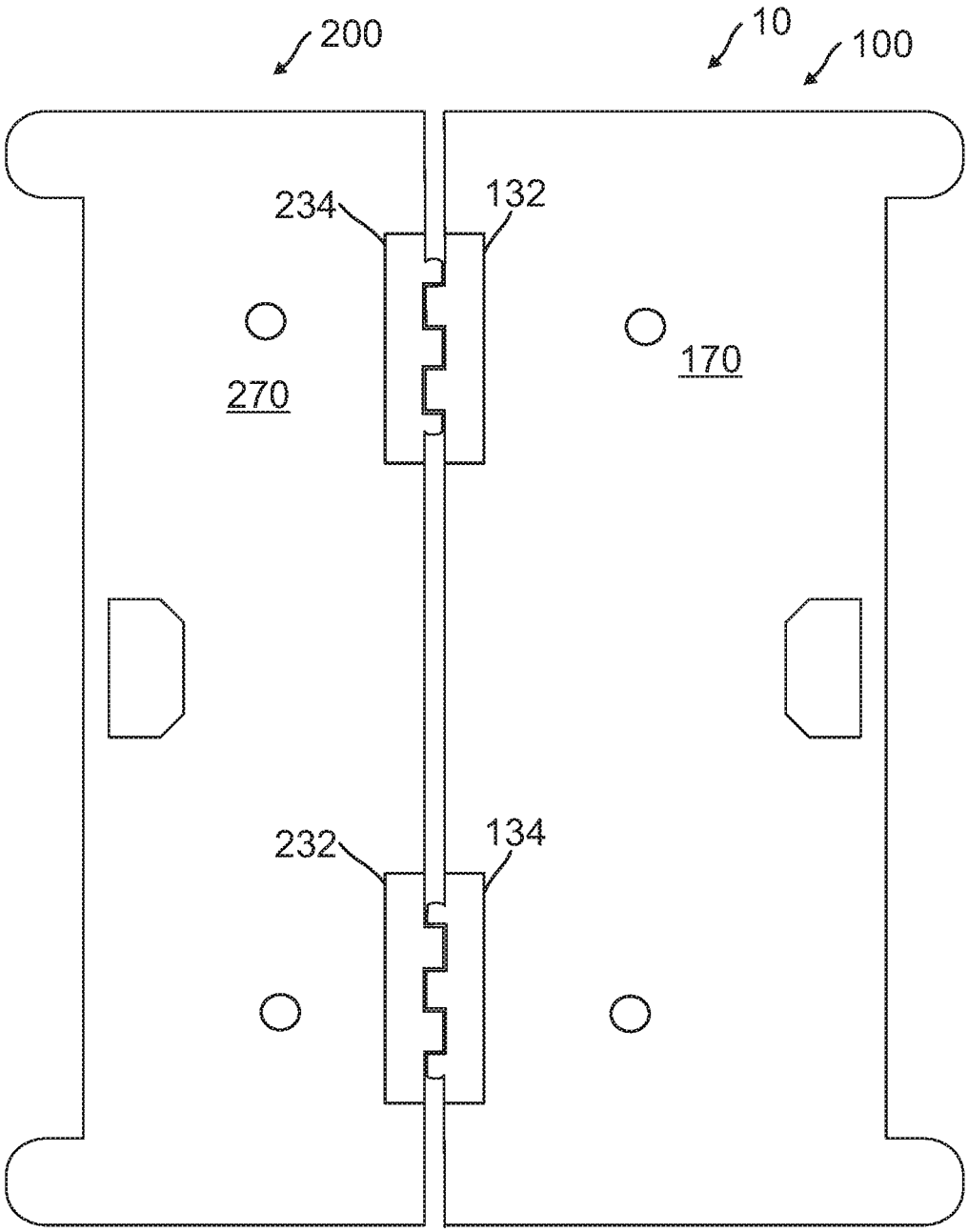
FIG. 2 is a bottom plan view of the embodiment of the present invention ladder safety support device illustrated in FIG. 1, in the unused condition.

Referring to FIG. 1, there is illustrated a top plan view of an embodiment of the present invention ladder safety support device in the unused condition. Referring to FIG. 2, there is illustrated a bottom plan view of the embodiment of the present invention ladder safety support device in the unused condition.

The ladder safety support device 10 includes two sections, a wide section 100 and a narrow section 200. Referring to FIG. 1, the wide section 100 is made of material selected from the group consisting of diamond plate aluminum, diamond plate steel, diamond plate ABS plastic diamond plate polyethylene and diamond plate hard plastic. (To shorten the text, sometimes when referring to section 100, the group just defined is collectively referred to as "wide section diamond plate"). Described generally, wide section 100 can be described as having diamond plate projections. The wide section 100 includes a top surface 110 having a multiplicity of diamond plate projections thereon, including, by way of example, 120A, 120B, 120C, 120D, 120E and 120F. The diamond plate projections extend at spaced apart locations over the entire top surface 110. The wide section 100 includes a back edge 130 with a first gap 132 (more clearly illustrated in FIG. 2) to retain a first hinge bracket 136 and a spaced apart second gap 134 to retain a second hinge bracket 138. The wide section 100 further includes a first side edge portion 140, a spaced apart second edge portion 150 and a front U-shaped portion 160 with laterally spaced apart forwardly extending arms 162 and 164 and a front edge 166 between arms 162 and 164. Referring to FIG. 2, the wide section 100 includes a bottom surface 170 which is illustrated with a plain surface but which is a mirror images of all of the components of the top surface 110. The wide section 100 also includes a ladder securing opening 190 extending from the top surface 110 to the bottom surface 170 and located adjacent to and separated from front edge 166. Preferably, the ladder securing opening is centered between first side edge portion 140 and second side edge portion 150.

Further referring to FIG. 1, the narrow section 200 is made of material selected from the group consisting of diamond plate aluminum, diamond plate steel, diamond plate ABS plastic, diamond plate polyethylene and diamond plate hard plastic. (To shorten the text, sometimes when referring to section 200, the group just defined is collectively referred to as "narrow section diamond plate"). Section 200 can also be generally referred to as having diamond plate projections. The narrow section 200 includes a top surface 210 having a multiplicity of diamond plate projections thereon, including by way of example, 220A, 220B, 220C, 220D, 220E and 220F. The diamond plate projections extend at spaced apart locations over the entire top surface 210. The narrow section 200 includes a back edge 230 with a fourth gap 234 to retain a fourth hinge bracket 238 and a spaced apart third gap 232 to retain a third hinge bracket 236. The narrow section 200 further includes a fourth side edge portion 240, a spaced apart third edge portion 250 and a front U-shaped portion 260 with laterally spaced apart forwardly extending arms 262 and 264 and a front edge 266 between arms 262 and 264. Referring to FIG. 2, the narrow section 200 includes a bottom surface 270 which is illustrated with a plain surface but which is a mirror images of all of the components of the top surface 210. The narrow section 200 also includes a ladder securing opening 290 extending from the top surface 210 to the bottom surface 270 and located adjacent to and separated from front edge 266. Preferably, ladder securing opening 290 is centered between fourth side edge portion 240 and third side edge portion 250. The narrow section 200 is illustrated with its back edge 230 the way it will appear if it is reversed and affixed to a top parapet roof surface.

Further referring to FIG. 1, the narrow section 200 is preferably made of metal, preferably aluminum diamond plate metal.

First hinge bracket 136 is rotatably connected to fourth hinge bracket 238 by a connecting pin 139 and second hinge bracket 138 is rotatably connected to the third hinge bracket 236 by a connecting pin 239. Therefore, wide section 100 is rotatably connected to narrow section 200. The first door hinge includes brackets 136 and 238 and connecting pin 139. The second door hinge includes brackets 138 and 236 and connecting pin 239.

Figure 3:
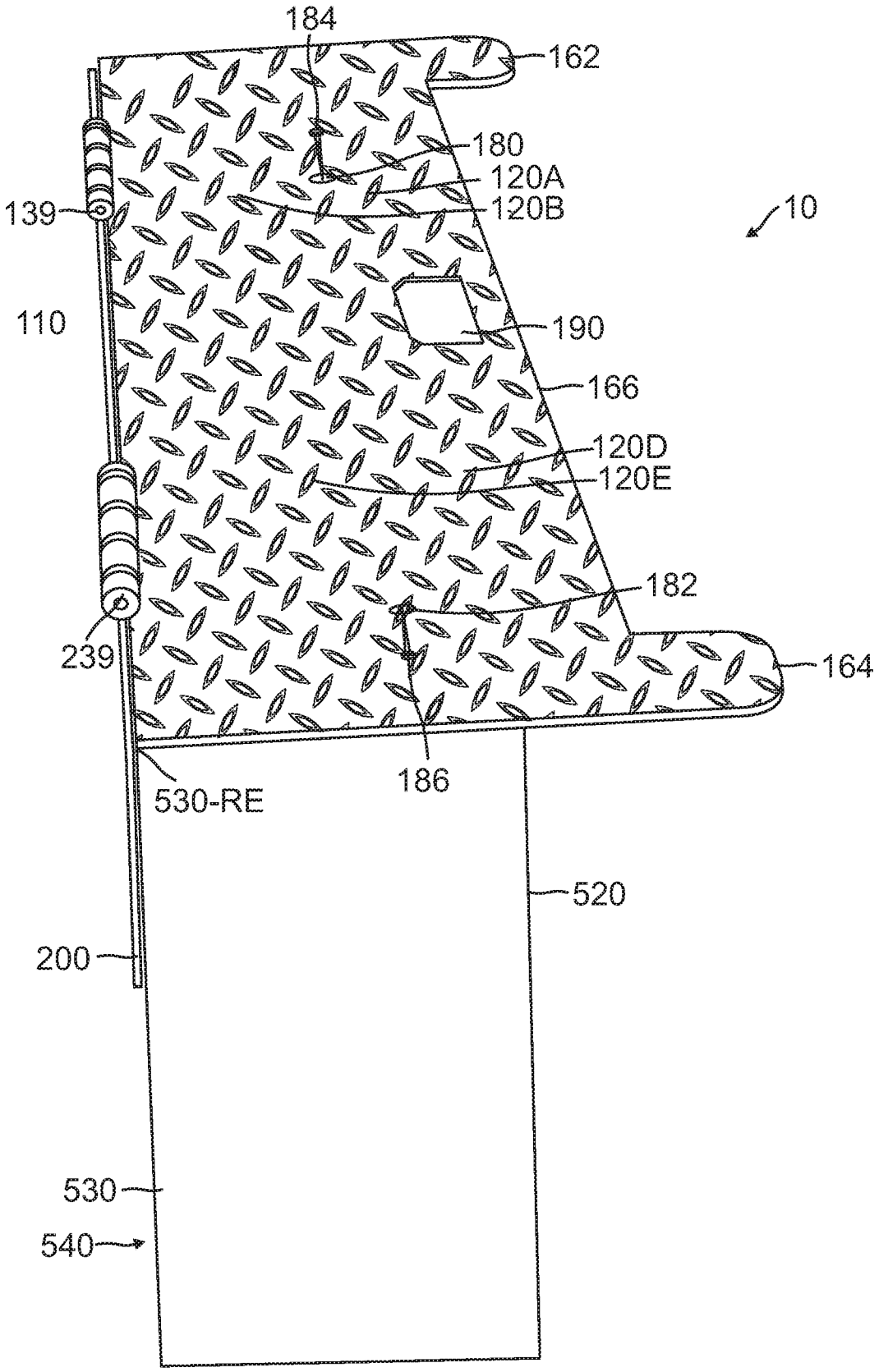
FIG. 3 is a top and side perspective view of the embodiment of the present invention ladder safety support device illustrated in FIG. 1, illustrating a pair of door hinges rotatably connecting the wide section and the narrow section and a diamond plate gripping surfaces, with the device installed with the wide section affixed to the top surface of the parapet roof wall and extending forward of the front side of the parapet roof wall, the narrow section extending downwardly against an interior surface of the parapet wall.
Figure 3A:
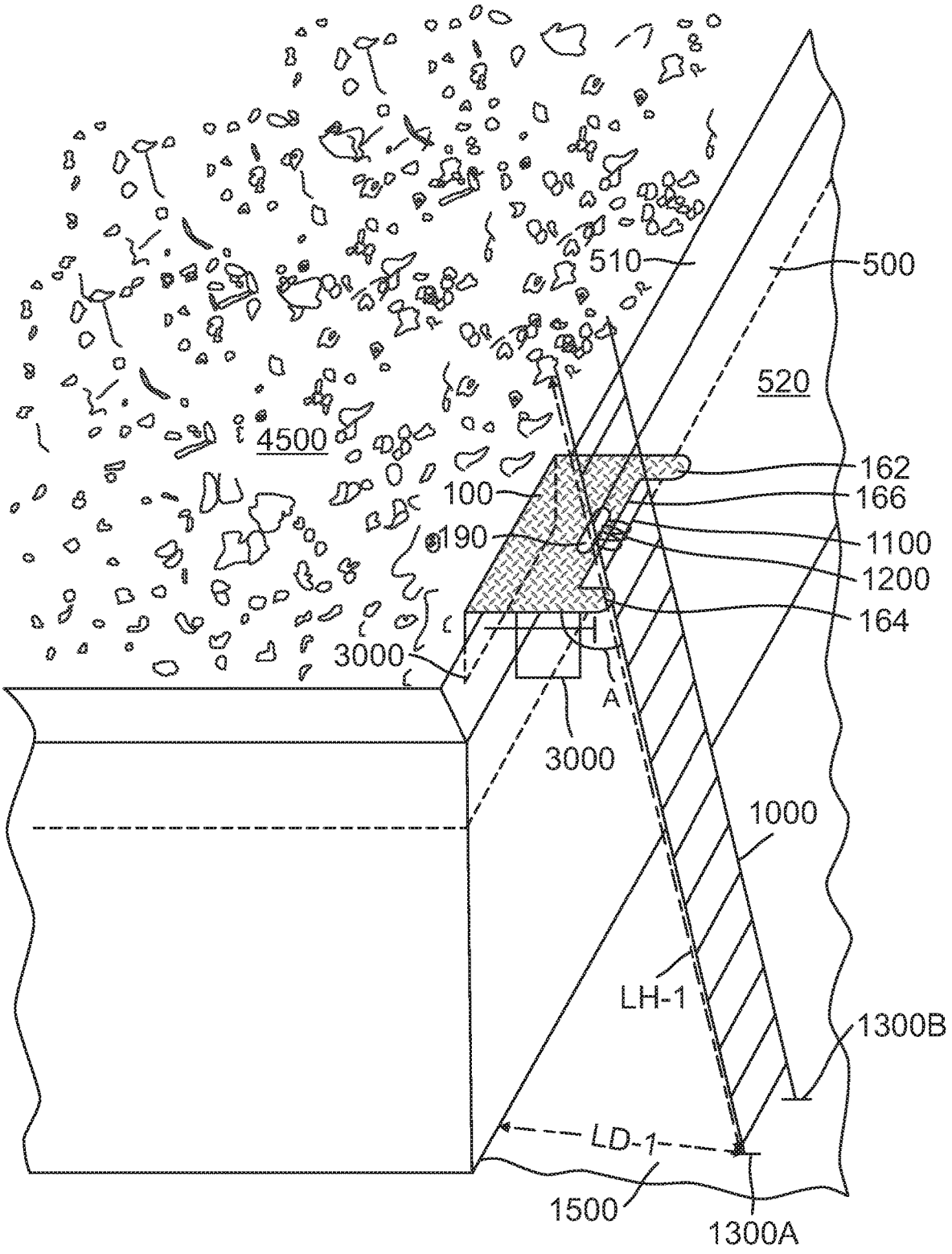
FIG. 3A is a side perspective view of the embodiment of the present invention illustrated in FIG. 3, including the pair of door hinges and the diamond plate surface, illustrating the ladder on the ground and affixed to the wide section, the ladder at an angle to avoid damaging the gutter.
Figure 3B:
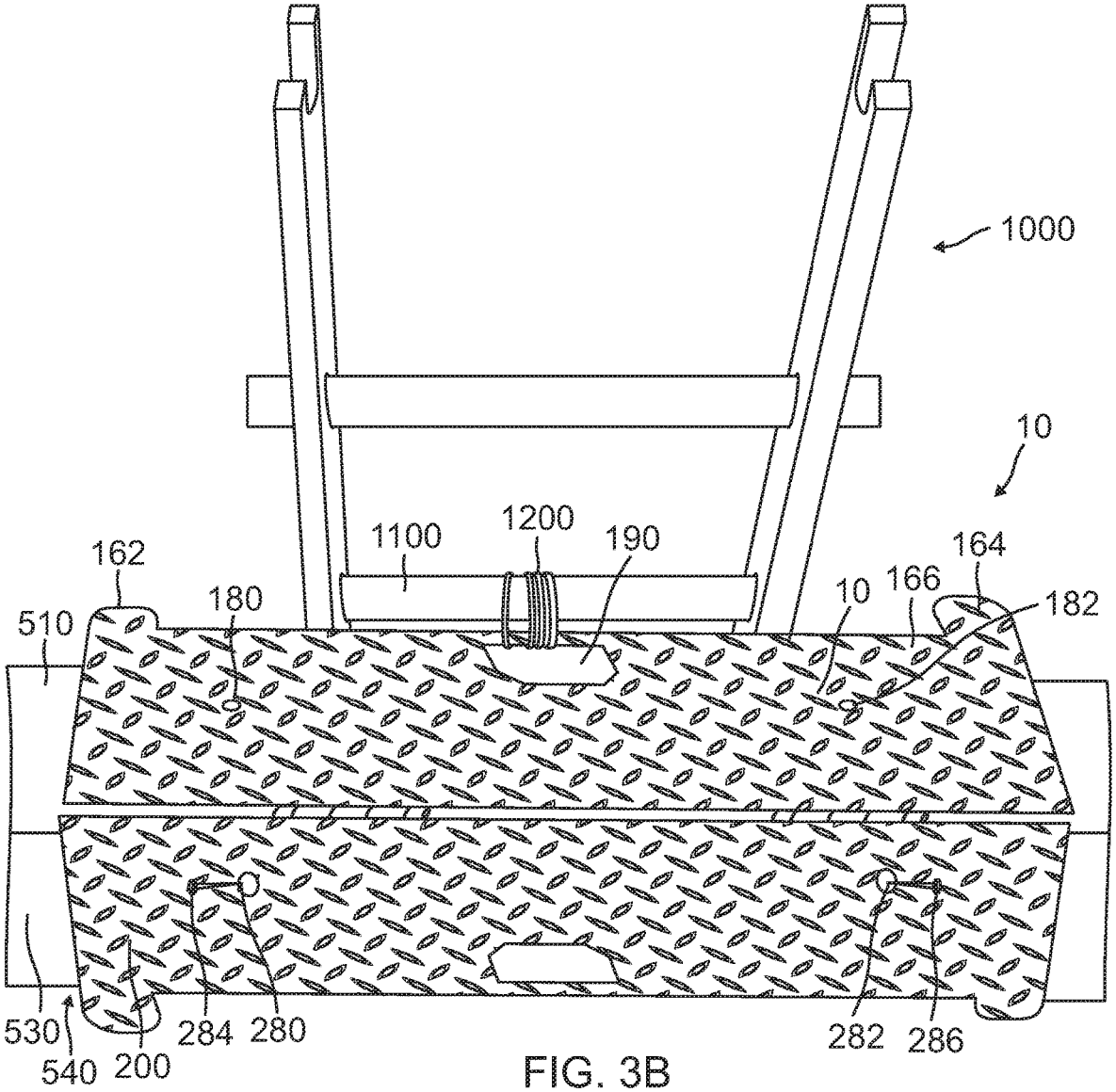
FIG. 3B is a rear perspective view of the upper portion of the embodiment of the present invention illustrated in FIG. 3, including a pair of door hinges and diamond plate surface, illustrating the upper portion of the ladder tied to the wide section opening and illustrating the narrow section against the interior surface of the front wall of the parapet roof.

The present invention ladder safety support device provides many innovations over prior art designs. First, the wide section 100 is used as the primary support for a wide roof such as a parapet roof Referring to FIG. 3, there is illustrated a top and side perspective view of the embodiment of the present invention ladder safety support device illustrated in FIG. 1. Referring to FIG. 3A, there is illustrated a side perspective view of the embodiment of the present invention illustrated in FIG. 3, illustrating a ladder 1000 with its feet 1300A and 1300B on the ground 1500 and affixed to the wide section 100, the ladder 1000 at an angle to avoid damaging the gutter. By way of example, the preferred angle is seventy-five degrees. Referring to FIG. 3B, there is illustrated a rear perspective view of the upper portion of the embodiment of the present invention illustrated in FIG. 3, illustrating the upper portion of the extension ladder tied to the wide section opening 190 and illustrating the narrow section 100 against the interior surface 530 of the rear wall 740 of the parapet roof.

Referring jointly to FIGS. 3, 3A and 3B, the device 10 shown installed with the wide section 100 affixed to the top surface 510 of the parapet roof wall 500 and extending forward of the front side wall 520 of the parapet roof wall 500. Wide section 100 includes at least one transverse opening 180 extending from the top surface 110 to the bottom surface 170. Preferably, there are two spaced apart openings 180 and 182 extending through the entire thickness of wide section 100 from the top surface 110 to the bottom surface 170. At least one affixing member such as nail 184 is hammered through at least one opening 180 into the top surface 510 of parapet roof wall 500. In addition, second affixing member such as nail 186 is hammered through opening 182 into top surface 510 of parapet roof wall 500.

Depending on how far it is desired for front edge 166 and arms 162 and 164 to extend beyond front side wall 520, the door hinge connecting pins can be at the rear edge

530-RE of parapet roof wall 500 so that narrow section 200 will hang down adjacent rear surface wall 540 of the parapet roof wall 500. There is at least one opening 280 but preferably, there are two spaced apart openings 280 and 282 extending through the entire thickness of narrow section 200 from the top surface 210 to the bottom surface 270. At least one affixing member such as nail 284 is hammered through opening 280 into the rear surface wall 540 of the parapet roof wall 500. In addition, a second affixing member such as nail 286 is hammered through opening 282 into the rear surface wall 540 of the parapet roof wall 500. This is a preferred embodiment.

It is within the spirit and scope of the present invention for the narrow section to be at a distance from the rear surface wall 540 to reduce the distance of the front edge 166 and arms 162 and 164 extending beyond front surface wall 520. In this variation, the hinges are further away and behind rear edge 530-RE of parapet roof wall 500.

Figure 4:
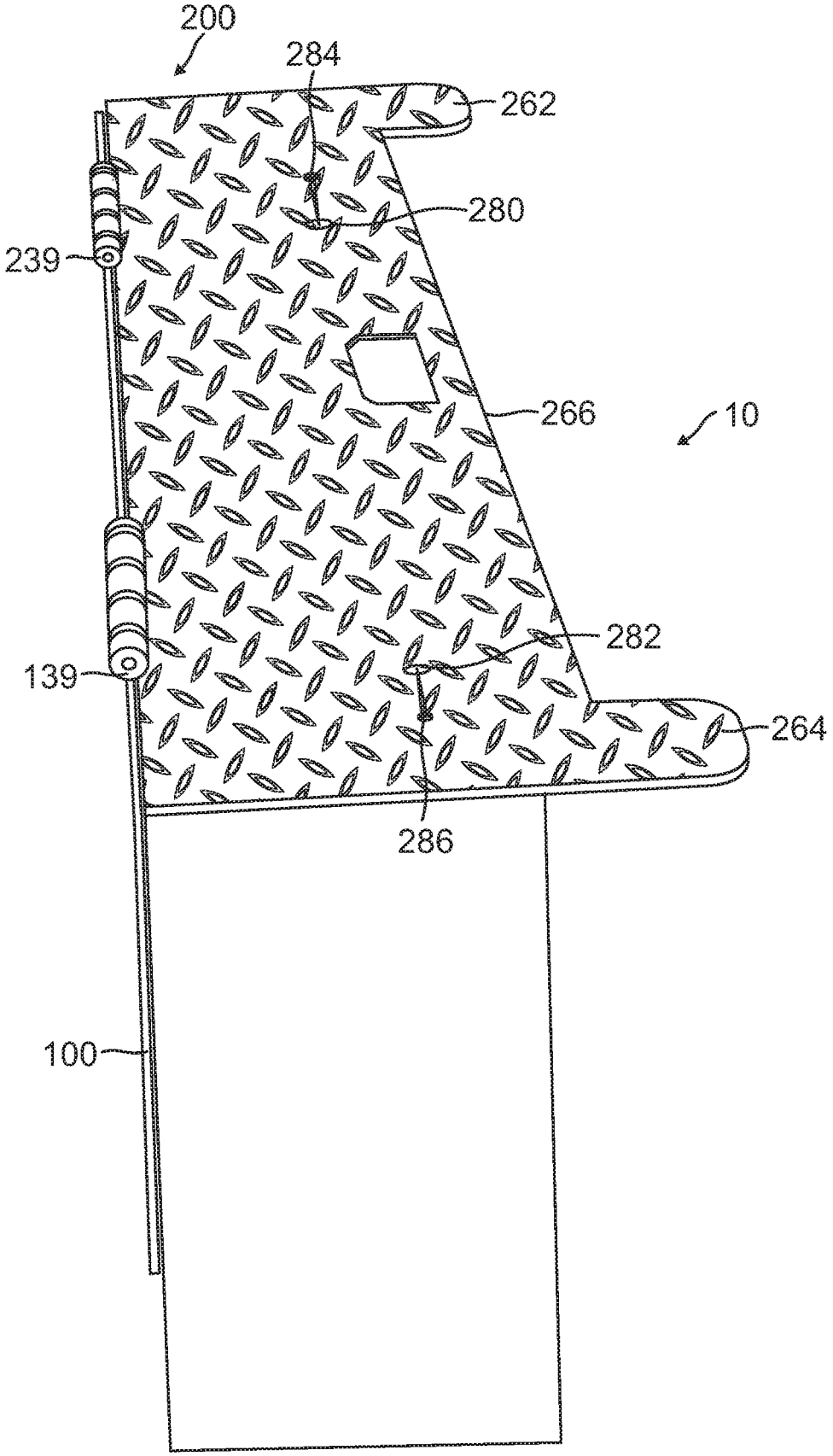
FIG. 4 is a top and side perspective view of the embodiment of the present invention ladder safety support device illustrated in FIG. 1, including a pair of door hinges and diamond plate surface, with the device installed with the narrow section affixed to the top surface of the parapet roof wall and extending forward of the front side of the parapet roof wall, the wide section extending downwardly against an interior surface of the parapet wall.
Figure 4A:
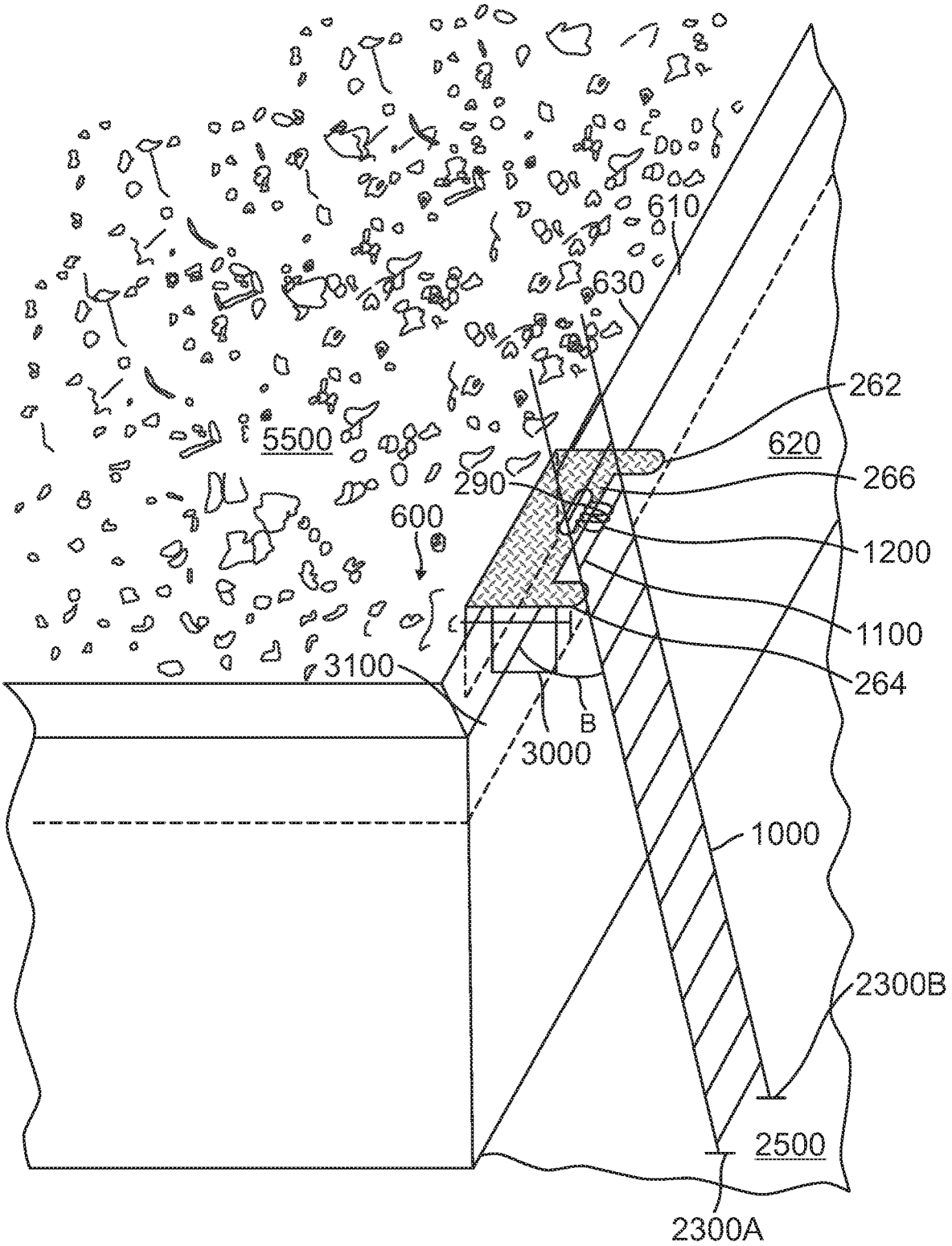
FIG. 4A is a side perspective view of the embodiment of the present invention illustrated in FIG. 4, including a pair of door hinges and diamond plate surface, illustrating the extension ladder on the ground and affixed to the narrow section, the ladder at an angle to avoid damaging the gutter.

In a second embodiment, the narrow section 200 is used as the primary support for a narrow roof such as a parapet roof Referring to FIG. 4, there is illustrated a side perspective view of the embodiment of the present invention ladder safety support device illustrated in FIG. 1 with the device installed with the narrow section 200 affixed to the top surface 510 of the parapet roof wall 500 and extending forward of the front side wall 520 of the parapet roof wall 500. Referring to FIG. 4A, there is illustrated a side perspective view of the embodiment of the present invention illustrated in FIG. 4, illustrating the ladder 1000 with its feet 1300A and 1300B on the ground 1500 and affixed to the narrow section 200, the ladder 1000 at an angle to avoid damaging the gutter. As additional security, A ladder fastening member 2200 such as a strong rope, chain, bungee cord, etc. is wrapped through opening 290 and around a rung of ladder 1000.

Narrow section 200 includes at least one transverse opening 280 extending from the top surface 210 to the bottom surface 270. Preferably, there are two spaced apart openings 280 and 282 extending through the entire thickness of narrow section 200 from top surface 210 to bottom surface 270. An affixing member such as nail 284 is hammered through opening 280 into the top surface 510 of parapet roof wall 500. In addition, a second affixing member such as nail 286 is hammered through opening 282 into top surface 510 of parapet roof wall 500. Depending on how far it is desired for front edge 266 and arms 262 and 264 to extend beyond front side wall 520, the door hinge connecting pins can be at the rear edge 530-RE of parapet roof wall 500 so that wide section 100 hangs down adjacent rear surface wall 540 of the parapet roof wall 500.

Wide section 100 includes at least one transverse opening 180 extending from the top surface 110 to the bottom surface 170. Preferably, there are two spaced apart openings 180 and 182 extending through the entire thickness of wide section 100 from the top surface 110 to the bottom surface 170. An affixing member such as nail 184 is hammered through opening 180 into the rear surface wall 540 of parapet roof wall 500. In addition, a second affixing member such as nail 186 is hammered through opening 182 into the rear surface wall 540 of parapet roof wall 500. This is a preferred embodiment.

If it is desired to have less extension of front edge wall 166 and arms 162 and 164 to extend in front of parapet front wall 510, then the door hinges are further away and behind rear edge 530 of parapet roof wall 500. The bottom surface 270 lies flat against top wall 510 of parapet roof wall 500.

To repeat, one preferred use of the present invention is to provide a ladder safety support for a wide top parapet roof. Referring to FIG. 3, there is illustrated a rear front and side perspective view of the embodiment of the present invention ladder safety support device illustrated in FIG. 1 with the device installed with the wide section 100 affixed to the top surface 510 of the parapet roof wall 500 and extending forward of the front side 520 of the parapet wall 500 as described in detail above with references to FIGS. 1, 2, and 3. Referring to FIGS. 3A and 3B, an extension ladder 1000 rests on the front edge 166 between arms 162 and 164 to prevent side-to-side movement of extension ladder 1000. As additional security, a ladder step fastening member 1200 such as a strong rope, chain, bungee cord, etc. is wrapped through front central opening 190 of wide section 100 and wrapped around at least one step or rung 1100 of extension ladder 1000 to prevent the extension ladder from falling away from the ladder support device wide section 100. Preferably, the ladder step fastening member 1200 includes several wraps around both the front central opening 190 and step or rung 1100 of extension ladder 1000.

As illustrated in FIG. 3A, the feet 1300A and 1300B of extension ladder 1000 rest on a horizontal ground surface 1500 so that extension ladder 1000 is at an angle "A" of seventy-five degrees relative to top surface wall 510 of parapet roof wall 500, which angle of seventy-five degrees is the equivalent of the distance from the feet of the ladder to the front wall of the parapet roof being equal to one-quarter the height of the ladder. By way of example, ladder 1000 has a height or length LH-1 of 12 feet and a distance from the feet of the ladder to the front wall of the parapet roof LD-1 of three feet. The angle is required in order to avoid damaging a gutter 3000 which runs along the front surface wall 520 adjacent top surface wall 510 of parapet of wall 500.

To repeat, a second use of the present invention is to provide a ladder safety support for a narrow top parapet roof Referring to FIG. 4, there is illustrated a rear front and side perspective view of the embodiment of the present invention ladder safety support device illustrated in FIGS. 1, 2 and 4 with the device installed with the narrow section 200 affixed to the top surface 510 of the parapet roof wall 500 and extending forward of the front side wall 520 of the parapet roof wall 500 as described in detail above with reference to FIGS. 1, 2, 4 and 4A. A ladder 1000 rests on the front edge 266 between arms 262 and 264 to prevent side-to-side movement of the ladder 1000. As additional security, a ladder step fastening member 1200 such as a strong rope, chain, bungee cord, etc. is wrapped through front central opening 290 in narrow section 200 and wrapped around at least one step or rung 1100 of extension ladder 1000 to prevent the extension ladder from falling away from the ladder support device narrow section 200.

Preferably, the ladder step fastening member 2200 includes several wraps around both the front central opening 290 and step or rung 1100 of extension ladder 1000. As illustrated in FIG. 4A, the feet 2300A and 2300B of ladder 1000 rest on a horizontal ground surface 1500 so that ladder 1000 is at an angle "B" of seventy-five degrees relative to top surface wall 510 of parapet roof wall 500, which angle of seventy-five degrees is the equivalent of the distance from the feet of the ladder to the front wall of the parapet roof being equal to one-quarter the height of the ladder. The angle is required in order to avoid damaging a gutter 3100 which runs along the front surface wall 520 adjacent top surface wall 510 of parapet of wall 500.

In addition to having a double wide different width ladder safety device 10 and providing security to ladder 1000 resting on a ground surface at one end and extending above the present invention ladder safety device and resting against front wall 166 of wide section 100 and providing security to ladder 1000 resting on a ground surface at one end and extending above the present invention ladder safety device and resting against front wall 266 of narrow section 200, the present invention is also used to support a smaller ladder to enable a worker to climb out of a deep parapet roof. In general, the parapet roof may only be one or two feet deep. A worker must then jump over the parapet top wall and land on the top surface of a ladder safety device and rely of the diamond plate to be sure the worker's boots grip the diamond plate as a worker climbs onto the ladder 1000.

With the present invention design, the ladder safety device can be used to support two ladders, the main safety ladder from the ground to the ladder safety device and a smaller ladder from the roof to the ladder safety device. so that a small ladder can be anchored to the interior surface of the roof and retained against the front surface and between the arms to safely climb out of a deeper parapet roof and onto the surface with the diamond plates. This can be accomplished in the following way.

Figure 5:
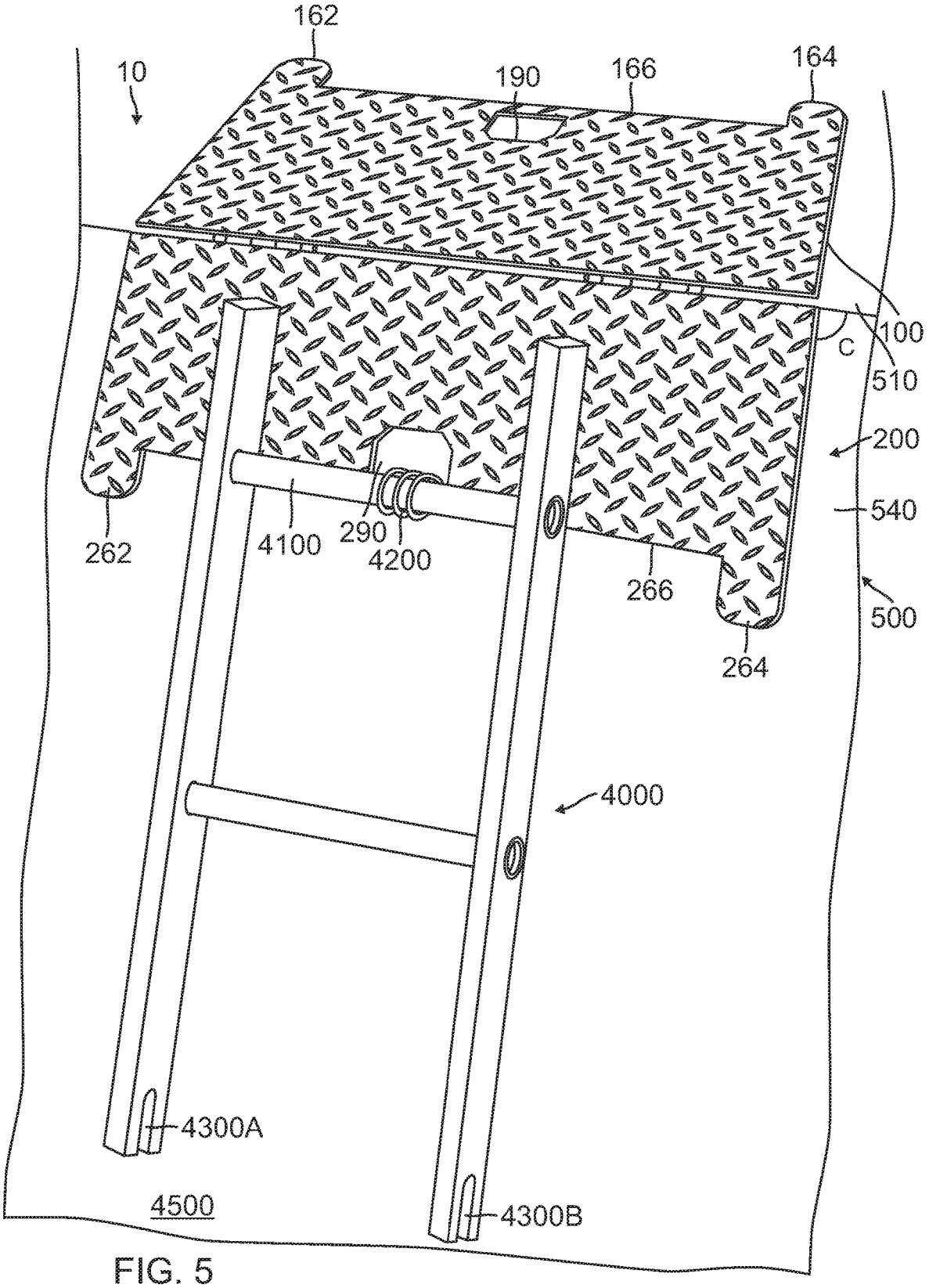
FIG. 5 is a rear front and side perspective view of the embodiment of the present invention ladder safety support device illustrated in FIG. 1, FIG. 2 and FIG. 3 including a pair of door hinges and diamond plate surface, with the device installed with the wide section affixed to the top surface of the parapet wall and extending forward of the front side of the parapet wall (the front extension ladder between the ladder safety device not illustrated for visual clarity) and a small ladder (either a step ladder or a small ladder between two feet and six feet) on the interior roof and tied to a portion of the narrow section extending at an angle relative to the interior surface of the parapet wall and tied to the opening of the narrow section.
Figure 6:
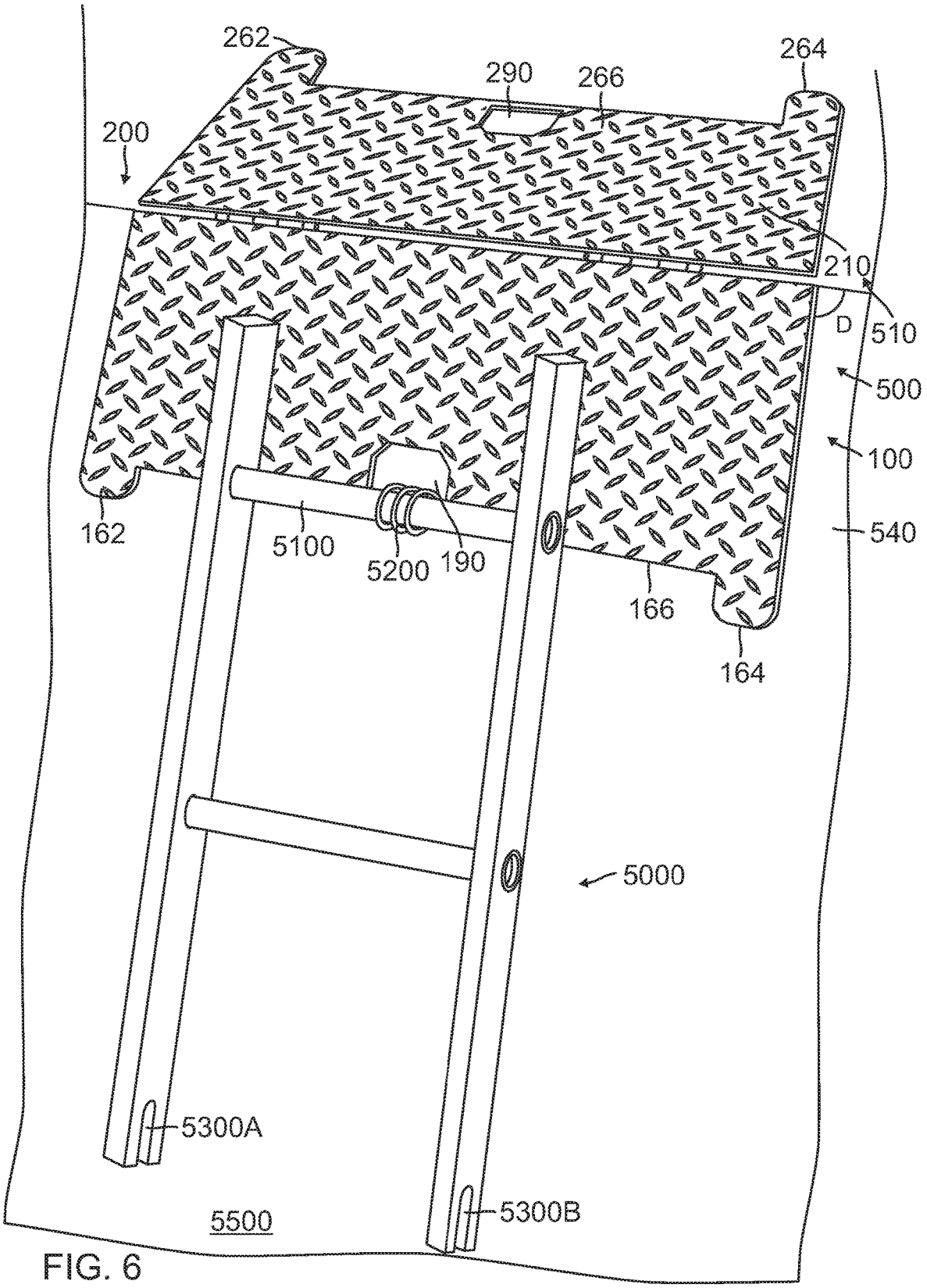
FIG. 6 is a rear front and side perspective view of the embodiment of the present invention ladder safety support device illustrated in FIG. 1, FIG. 2 and FIG. 4 including a pair of door hinges and diamond plate surface, with the device installed with the narrow section affixed to the top surface of the parapet wall and extending forward of the >, 13 front side of the parapet wall (the front extension ladder between the ladder safety device not illustrated for visual clarity) and a small ladder (either a step ladder or a small ladder between two feet and six feet) on the interior roof and tied to a portion of the wide section extending at an angle relative to the interior surface of the parapet wall and tied to the opening of the wide section.

Referring to FIG. 5, there is illustrated a rear front and side perspective view of the embodiment of the present invention ladder safety support device illustrated in FIGS. 1, 2 and 3 including a pair of door hinges and diamond plate surface, with the device installed with the wide section affixed to the top surface of the parapet wall and extending forward of the front side of the parapet wall (the front extension ladder between the ladder safety device not illustrated for visual clarity) and a small ladder (either a step ladder or a small ladder between two feet and six feet) on the interior roof and tied to a portion of the narrow section extending at an angle relative to the interior surface of the parapet wall and tied to the opening of the narrow section;

FIG. 6 is a rear front and side perspective view of the embodiment of the present invention ladder safety support device illustrated in FIG. 1, FIG. 2 and FIG. 4 including a pair of door hinges and diamond plate surface, with the device installed with the narrow section affixed to the top surface of the parapet wall and extending forward of the front side of the parapet wall (the front extension ladder between the ladder safety device not illustrated for visual clarity) and a small ladder (either a step ladder or a small ladder between two feet and six feet) on the interior roof and tied to a portion of the wide section extending at an angle relative to the interior surface of the parapet wall and tied to the opening of the wide section;

Referring to FIG. 5, a worker takes the ladder safety device 10 and affixes one section such as the wide section 100 to the top surface wall 510 of the parapet roof wall 500 to retain the ladder 1000 from the ground to the front wall 166 between arms 162 and 164 and secured with a rope 1200 wrapped around one ladder step 1100 and ladder securing opening 190 as previously described. With the second narrow section 200, instead of letting it hang down or nailed to the back of the back surface wall 540 of the parapet roof wall 500, the second section 200 extends either in line with first section 100 or at a slight angle "C" relative to rear surface wall 540. A small step ladder or small ladder is positioned so that its feet 4300A and 4300B rest on horizontal interior roof surface 4500 and the small adder 4000 is positioned against the front wall 266 between arms 262 and 264 and retained with a rope or chain 4200 wrapped around a step or rung 4100 of the ladder 4000 and ladder securing opening 290 in the narrow section 200. Preferably, there are several wrappings around both step or rung 4100 and ladder securing opening 290. The worker then climbs up small extension ladder 4000 and onto top surface 110 of wide section 100 and onto extension ladder 1000.

Referring to FIG. 5, a worker takes the ladder safety device 10 and affixes one section such as the wide section 100 to the top surface wall 510 of the parapet roof wall 500 to retain the ladder 1000 from the ground to the front wall 166 between arms 162 and 164 and secured with a rope 1200 wrapped around one ladder step 1100 and ladder securing opening 190 as previously described. With the second narrow section 200, instead of letting it hang down or nailed to the back of the back surface wall 540 of the parapet roof wall 500, the second section 200 extends either in line with first section 100 or at a slight angle "C" relative to rear surface wall 540. A small step ladder or small ladder is positioned so that its feet 4300A and 4300B rest on horizontal interior roof surface 4500 and the small adder 4000 is positioned against the front wall 266 between arms 262 and 264 and retained with a rope or chain 4200 wrapped around a step or rung 4100 of the ladder 4000 and ladder securing opening 290 in the narrow section 200. Preferably, there are several wrappings around both step or rung 4100 and ladder securing opening 290. The worker then climbs up small extension ladder 4000 and onto top surface 110 of wide section 100 and onto extension ladder 1000.

Referring to FIG. 6, there is illustrated a view of the embodiment of the present invention ladder safety support device illustrated in FIGS. 1, 2 and 4 including a pair of door hinges and diamond plate surface, with the device installed with the narrow section affixed to the top surface of the parapet wall and extending forward of the front side of the parapet wall (the front ladder between the ladder safety device not illustrated for visual clarity) and a small ladder (either a step ladder or a small ladder between two feet and six feet) on the interior roof and tied to a portion of the wide section extending at an angle relative to the interior surface of the parapet wall and tied to the opening of the wide section;

It is also within the spirit and scope of the present invention to use the same concept with the ladder support safety device 10 as illustrated in FIG. 4. Referring to FIG. 6, a worker takes the ladder safety device 10 and affixes one section such as the narrow section 200 to the top surface wall 50 of the parapet roof wall 500 to retain the ladder 1000 from the ground to the front wall 266 between arms 262 and 264 and secured with a rope 2200 wrapped around one ladder step or rung 1100 and ladder securing opening 290 as previously described.

With the first wide section 100, instead of letting it hang down or having it nailed to the back of the back surface wall 540 of the parapet roof wall 500, the first section 100 extends either in line with second section 200 or at a slight angle "D" relative to rear surface wall 540. A small extension ladder 5000 is set so that its feet 5300A and 5300B rest on horizontal interior roof surface 5500 and the small extension ladder 5000 is positioned against the front wall 166 between arms 162 and 164 and retained with a rope or chain 5200 wrapped around a step or rung 5100 of the ladder 5000 and ladder securing opening 190 in the wide section 100. Preferably, there are several wrappings around both step or rung 5100 and ladder securing opening 190. The worker then climbs up small extension ladder 5000 and onto top surface 210 of narrow section 200 and onto extension ladder 2000.

Figure 7:
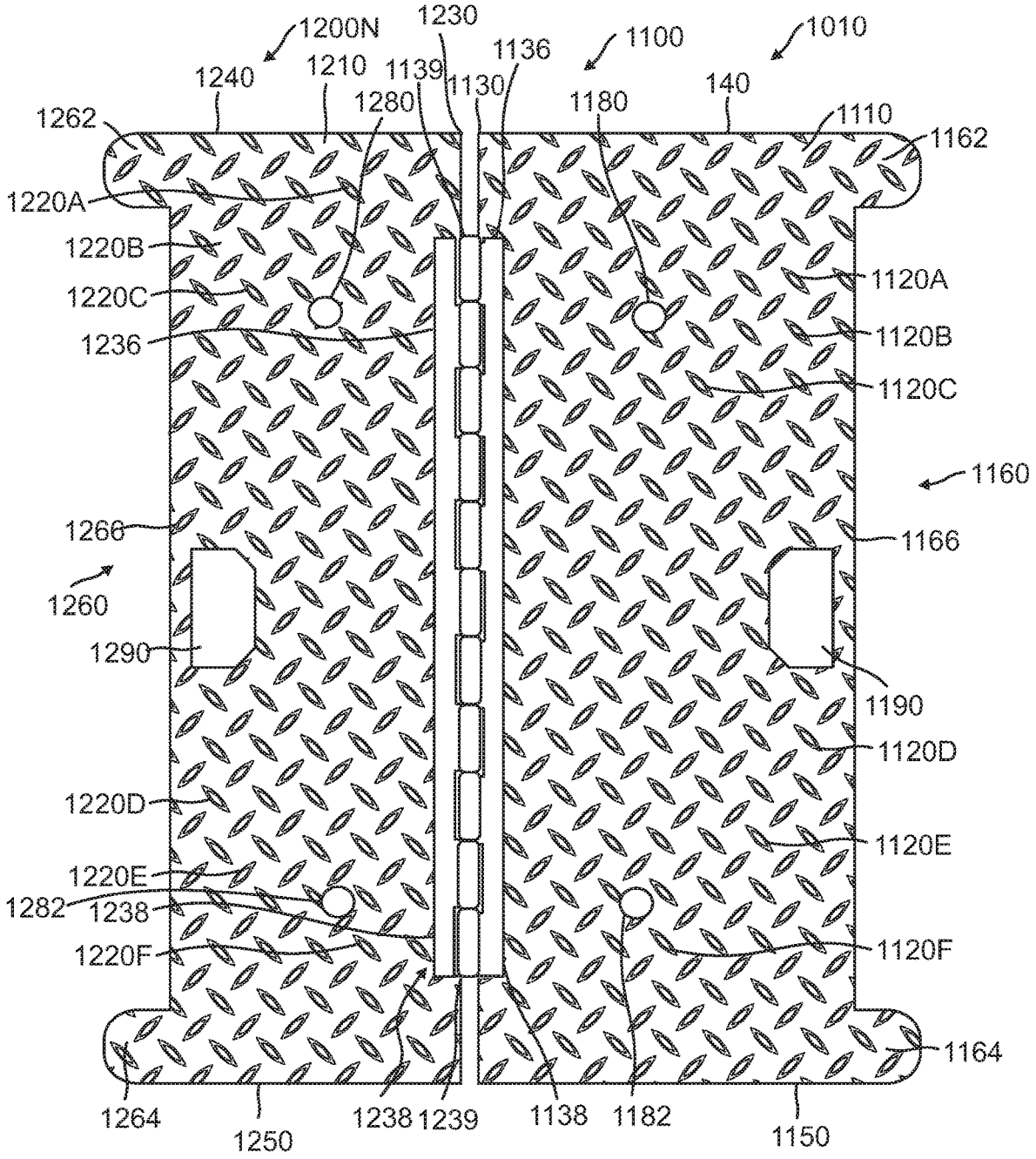
FIG. 7 is a top plan view of an embodiment of the present invention ladder safety support device in the unused condition, illustrating a piano hinge connecting the wide plate and the narrow plate, and a Durbar floor plate surfaces.

Referring to FIG. 7, there is illustrated a top plan view of an embodiment of the present invention ladder safety support device in the unused condition including a piano hinge and an embodiment which will be defined as Durbar floor plate.

Figure 8:
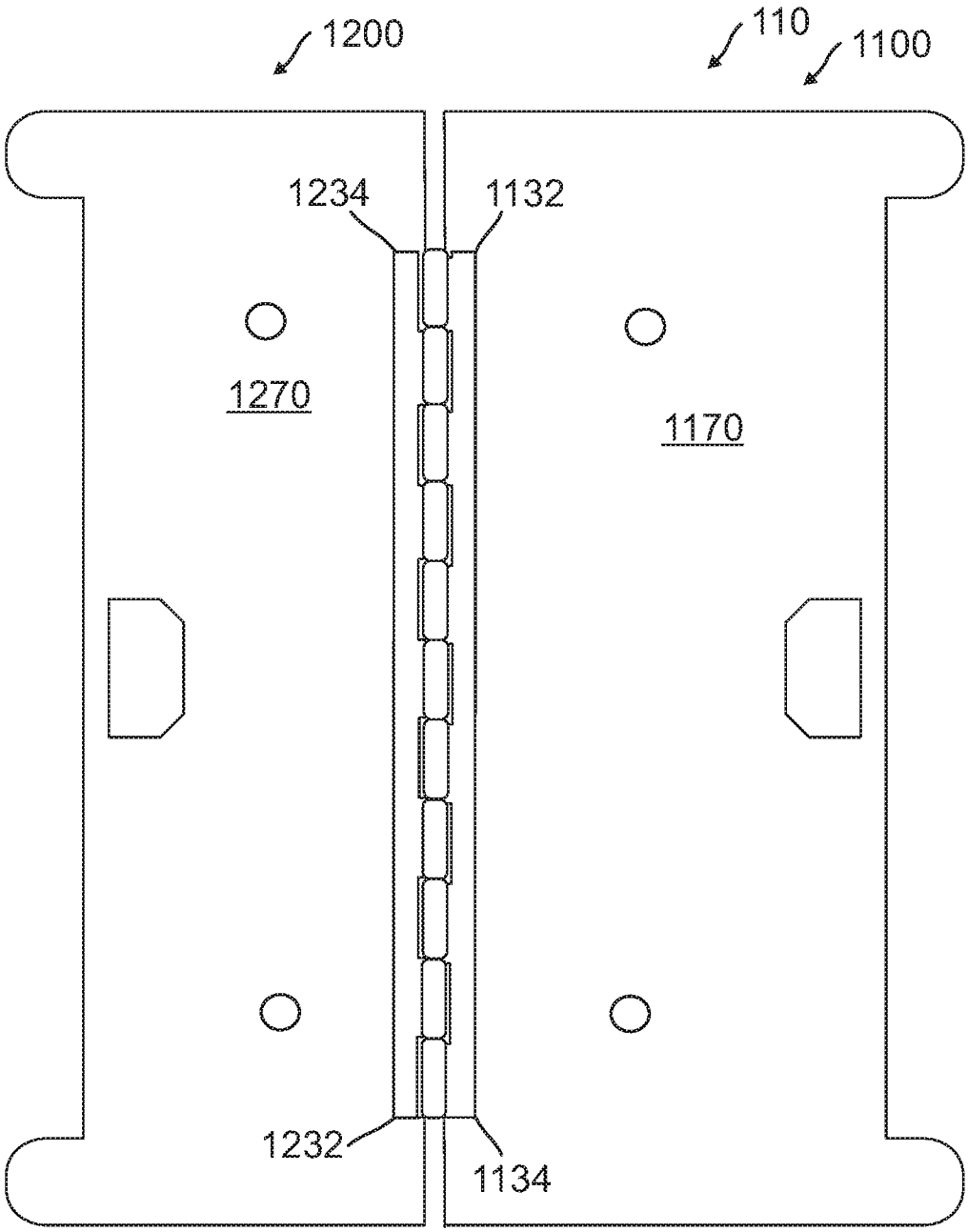
FIG. 8 is a bottom plan view of the embodiment of the present invention ladder safety support device illustrated in FIG. 7, in the unused condition, including a piano hinge and a Durbar floor plate surface.

Referring to FIG. 8, there is illustrated a bottom plan view of an embodiment of the present invention ladder safety support device in the unused condition including a piano hinge and a flat bottom surface.

The ladder safety support device 1010 includes two sections, a wide section 1100 and a narrow section 1200N. Referring to FIG. 7, the wide section 1100 is made of material selected from the group consisting of Durbar floor plate aluminum, Durbar floor plate steel, Durbar floor plate ABS plastic, Durbar floor plate polyethylene and Durbar floor plate hard plastic. (Sometimes when referring to section 1100, the group as just defined is collectively referred to as "wide section Durbar floor plate"). When generally referred to, the surface is referred to as Durbar floor plate projections. The wide section 1100 includes a top surface 1110 having a multiplicity of Durbar floor plate projections thereon, including, by way of example, 1120A, 1120B, and 1120C, spaced apart projections at the same angle in one transverse row and a second set of spaced apart projections 1120D, 1120E and 1120F at opposite angles in an adjacent row. The Durbar floor plate projections are in pairs of rows along the entire top surface 1110. The wide section 1100 includes a back edge 1130 with a smooth wall section 1132 to which is affixed a longitudinal mounting plate 1134 to retain a first half of a piano hinge bracket 1136. Narrow section 1200N has a back edge 1230 with a smooth wall section 1232 to which is affixed a second longitudinal mounting plate 1234 to retain a second half of a piano hinge bracket 1236 to receive and retain a longitudinal pin 1139 to complete the piano hinge 1238.

The wide section 1100 further includes a first side edge portion 1140, a spaced apart second edge portion 1150 and a front U-shaped portion 1160 with laterally spaced apart forwardly extending arms 1162 and 1164 and a front edge 1166 between arms 1162 and 1164. Referring to FIG. 8, the wide section 1100 includes a bottom surface 1170 illustrated with a plain surface but which is a mirror images of all of the components of the top surface 1110. The wide section 1100 also includes a ladder securing opening 1190 extending from the top surface 1110 to the bottom surface 1170 and located adjacent to and separated from front edge 1166. Preferably, the ladder securing opening is centered between first side edge portion 1140 and second side edge portion 1150.

Further referring to FIG. 8, the narrow section 1200N is made of material selected from the group consisting of Durbar floor plate aluminum, Durbar floor plate steel, Durbar floor plate ABS plastic, Durbar floor plate polyethylene and Durbar floor plate hard plastic. (Sometimes when referring to section 1200N, sometimes the group just defined is collectively referred to as "narrow section Durbar floor plate"). The projections on the 1200N narrow section can be generally referred to as having Durbar floor plate projections. The narrow section 1200N includes a top surface 1210 having a multiplicity of Durbar floor plate projections thereon, including by way of example, 1220A, 1220B, and 1220C, spaced apart projections at the same angle in one transverse row and a second set of spaced apart projections 1220D, 1220E and 1220F at opposite angles in an adjacent row. The Durbar floor plate projections are in pairs of rows along the entire top surface 1110. The portion to retain the piano hinge has already been described.

The narrow section 1200N further includes a fourth side edge portion 1240, a spaced apart third edge portion 1250 and a front U-shaped portion 1260 with laterally spaced apart forwardly extending arms 1262 and 1264 and a front edge 1266 between arms 1262 and 1264. Referring to FIG. 8, the narrow section 1200N includes a bottom surface 1270 which is illustrated plain but which is a mirror images of all of the components of the top surface 1210. The narrow section 1200N also includes a ladder securing opening 1290 extending from the top surface 1210 to the bottom surface 1270 and located adjacent to and separated from front edge 1266. Preferably, ladder securing opening 1290 is centered between fourth side edge portion 1240 and third side edge portion 1250.

Further referring to FIG. 7, the narrow section 1200N is preferably made of metal, preferably Durbar floor plate metal. The piano hinge 1238 rotatably connects wide section 1100 to narrow section 1200N.

Figure 9:
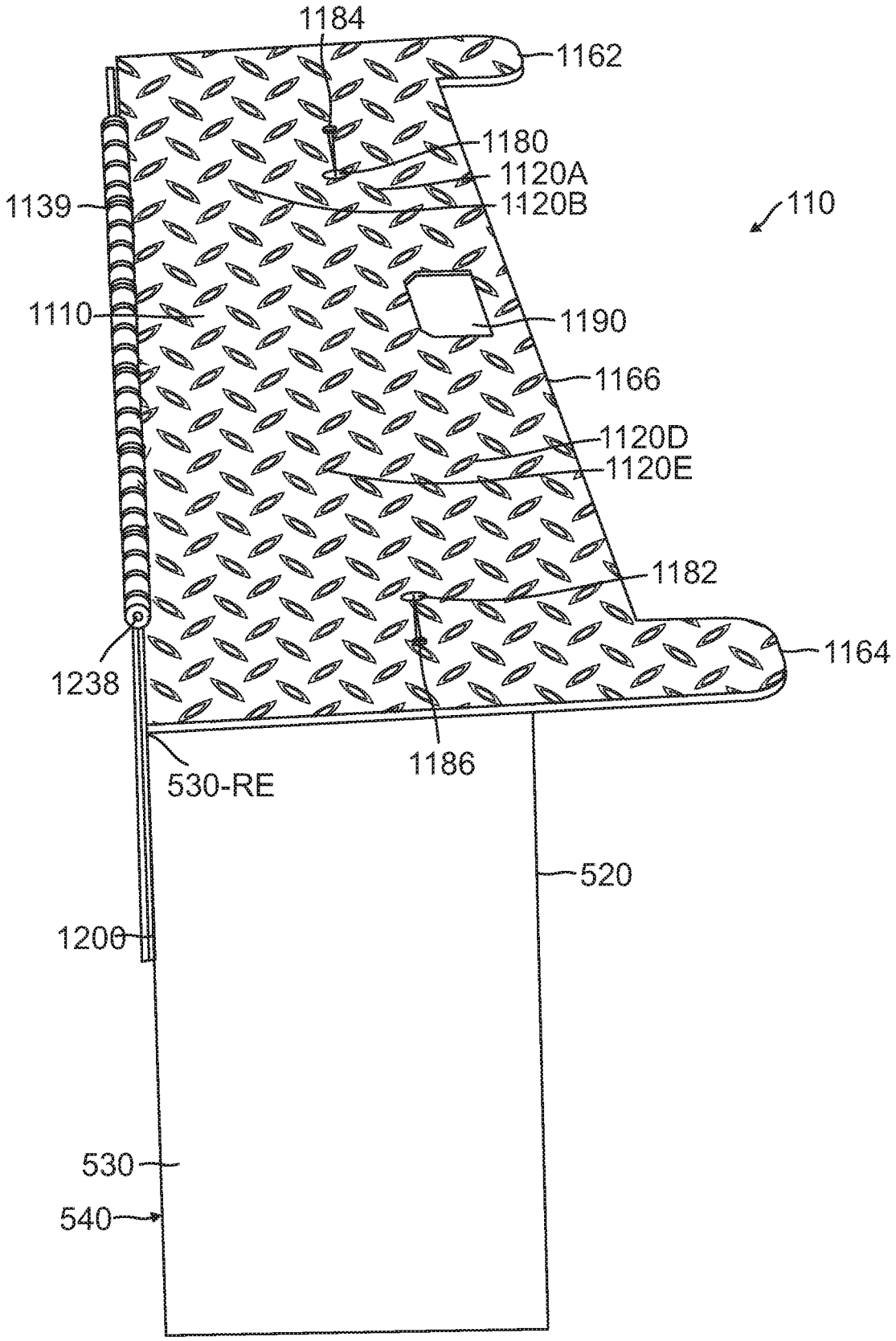
FIG. 9 is a top and side perspective view of the embodiment of the present invention ladder safety support device illustrated in FIG. 7, illustrating a piano hinge connecting the wide plate and the narrow pate, and a Durbar floor plate surface, with the device installed with the wide section affixed to the top surface of the parapet roof wall and extending forward of the front side of the parapet wall, the narrow section extending downwardly against an interior surface of the parapet wall.
Figure 9A:
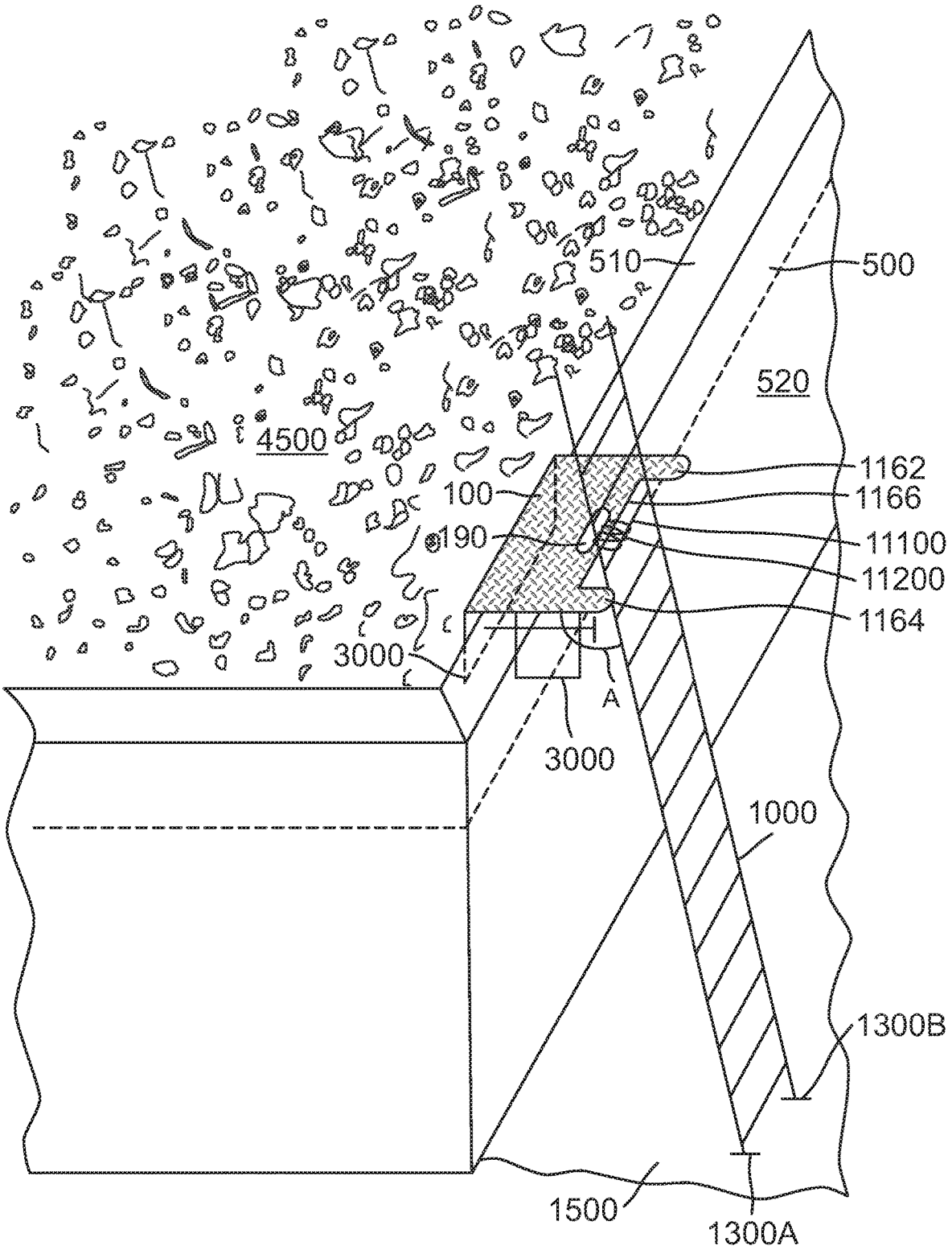
FIG. 9A is a side perspective view of the embodiment of the present invention illustrated in FIG. 9, illustrating a piano hinge connecting the wide plate and the narrow pate, and raised Dunbar floor plate gripping surfaces, illustrating the extension ladder on the ground and affixed to the wide section, the extension ladder at an angle to avoid damaging the gutter.
Figure 9B:
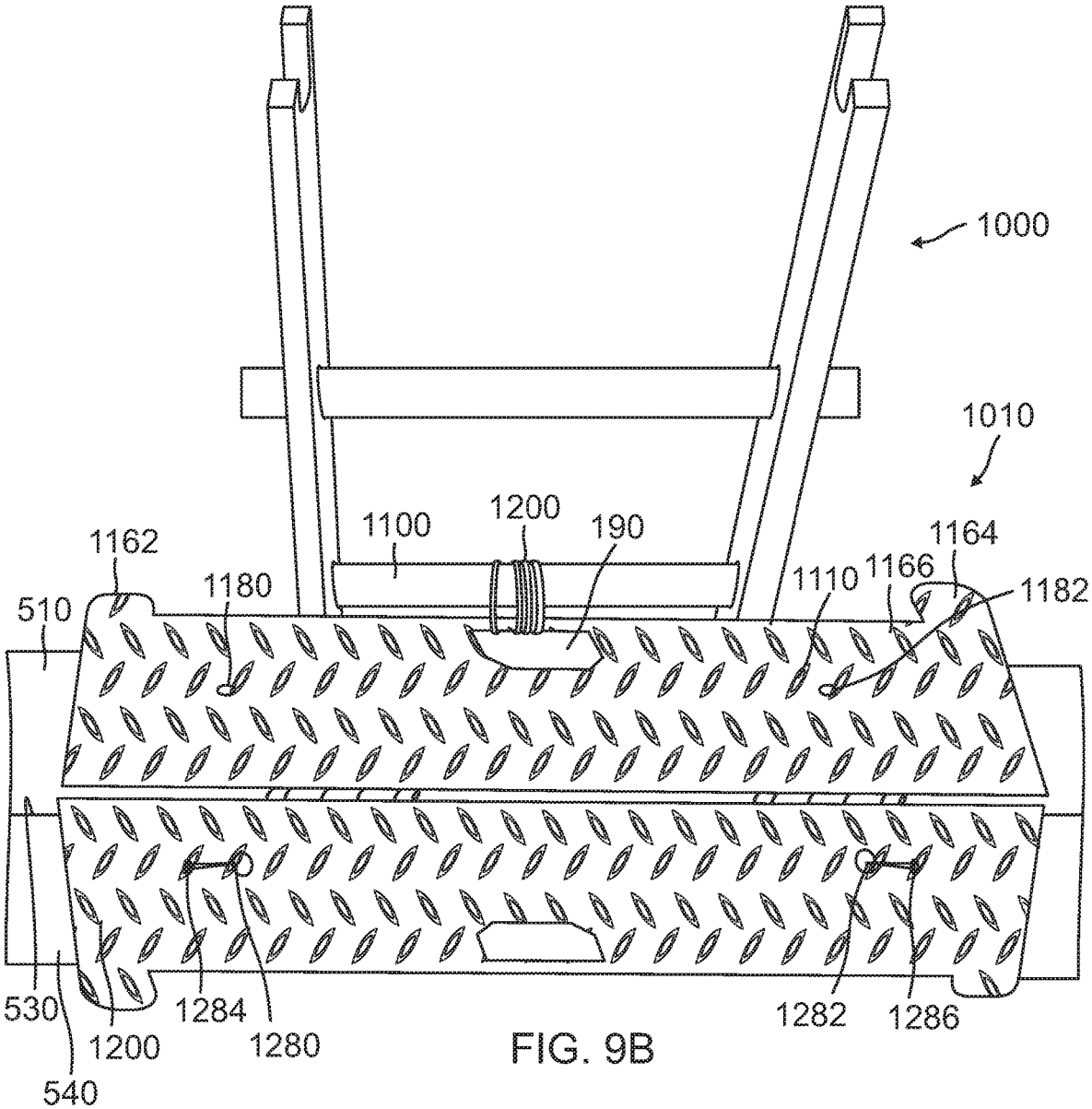
FIG. 9B is a rear perspective view of the upper portion of the embodiment of the present invention illustrated in FIG. 9, illustrating a piano hinge connecting the wide plate and the narrow pate, and Durbar floor plate gripping surfaces, illustrating the upper portion of the extension ladder tied to the wide section opening and illustrating the narrow section against the interior surface of the front wall of the parapet roof.

The present invention ladder safety support device provides many innovations over prior art designs. First, the wide section 1100 is used as the primary support for a wide roof such as a parapet roof Referring to FIG. 9, there is illustrated a top and side perspective view of the embodiment of the present invention ladder safety support device illustrated in FIG. 9. Referring to FIG. 9A, there is illustrated a side perspective view of the embodiment of the present invention illustrated in FIG. 9, illustrating the ladder on the ground and affixed to the wide section 1100, the extension ladder at an angle to avoid damaging the gutter. Referring to FIG. 9B, there is illustrated a rear perspective view of the upper portion of the embodiment of the present invention illustrated in FIG. 9, illustrating the upper portion of the ladder tied to the wide section opening 1190 and illustrating the narrow section 1200N against the interior surface 530 of the interior wall 540 of the parapet roof 500.

Referring jointly to FIGS. 9, 9A and 9B, the device 1010 shown installed with the wide section 1100 affixed to the top surface 510 of the parapet roof wall 500 and extending forward of the front side wall 520 of the parapet roof wall 500. Wide section 1100 includes at least one transverse opening 1180 extending from the top surface 1110 to the bottom surface 1170. Preferably, there are two spaced apart openings 1180 and 1182 extending through the entire thickness of wide section 1100 from the top surface 1110 to the bottom surface 1170. At least one affixing member such as nail 1184 is hammered through at least one opening 1180 into the top surface 510 of parapet roof wall 500. In addition, second affixing member such as nail 1186 is hammered through opening 1182 into top surface 510 of parapet roof wall 500.

Depending on how far it is desired for front edge 1166 and arms 1162 and 1164 to extend beyond front side wall 520, the piano hinge pin 1139 can be at the rear edge 530-RE of parapet roof wall 500 so that narrow section 1200N will hang down adjacent rear surface wall 540 of the parapet roof wall 500. There is at least one opening 1280 but preferably, there are two spaced apart openings 1280 and 1282 extending through the entire thickness of narrow section 1200N from the top surface 1210 to the bottom surface 1270. At least one affixing member such as nail 1284 is hammered through opening 1280 into the rear surface wall 540 of the parapet roof wall 500. In addition, a second affixing member such as nail 1286 is hammered through opening 1282 into the rear surface wall 540 of the parapet roof wall 500. This is a preferred embodiment.

It is within the spirit and scope of the present invention for the narrow section to be at a distance from the rear surface wall 540 to reduce the distance of the front edge 1166 and arms 1162 and 1164 extending beyond front surface wall 520. In this variation, the hinges are further away and behind rear edge 530 of parapet roof wall 500.

Figure 10:
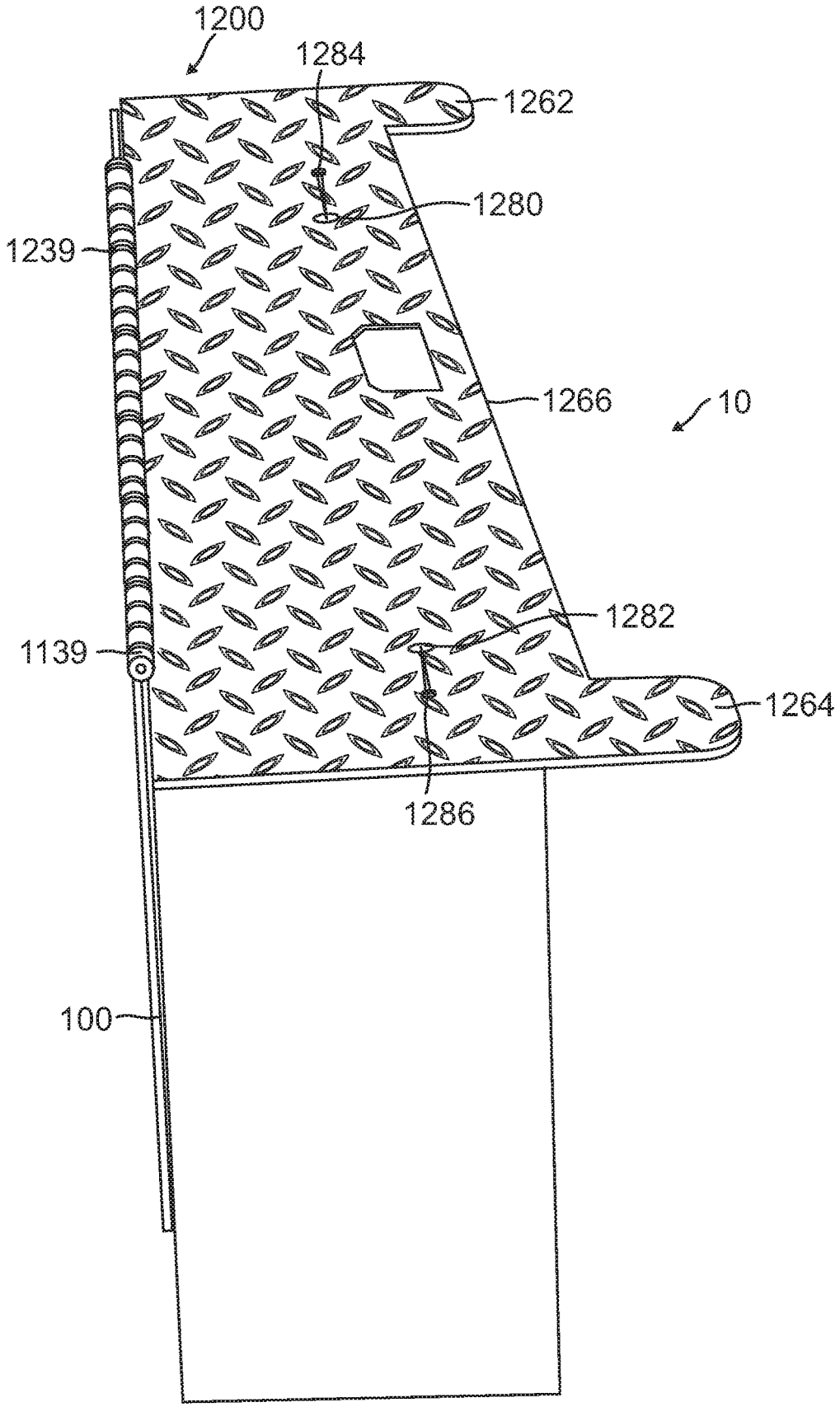
FIG. 10 is a top and side perspective view of the embodiment of the present invention ladder safety support device illustrated in FIG. 7, illustrating a piano hinge connecting the narrow plate and the wide plate, and Durbar floor plate gripping surfaces, with the device installed with the narrow section affixed to the top surface of the parapet roof wall and extending forward of the front side of the parapet wall, the wide section extending downwardly against an interior surface of the parapet wall.
Figure 10A:
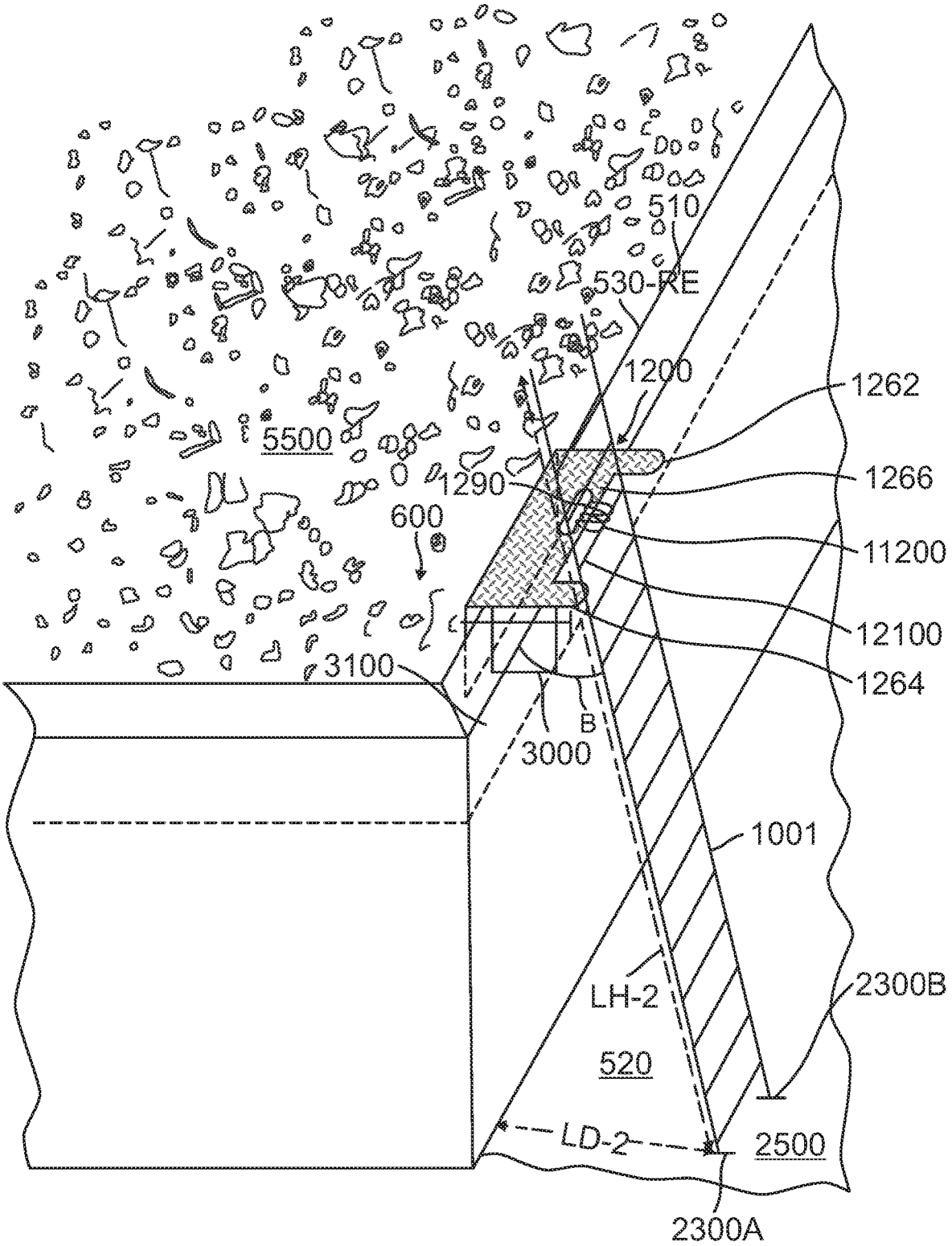
FIG. 10A is a side perspective view of the embodiment of the present invention illustrated in FIG. 10, illustrating a piano hinge connecting the wide plate and the narrow pate, and Durbar floor plate gripping surfaces, illustrating the ladder on the ground and affixed to the narrow section, the ladder at an angle to avoid damaging the gutter.

In a second embodiment, the narrow section 1200N is used as the primary support for a narrow roof such as a parapet roof. Referring to FIG. 10, there is illustrated a side perspective view of the embodiment of the present invention ladder safety support device illustrated in FIG. 7 with the device installed with the narrow section 1200N affixed to the top surface 510 of the parapet roof wall 500 and extending forward of the front side wall 520 of the parapet roof wall 500. Referring to FIG. 10A, there is illustrated a side perspective view of the embodiment of the present invention illustrated in FIG. 10, illustrating the ladder 1000 with its feet 2300A and 2300B on the ground 1500 and affixed to the narrow section 1200N, the ladder 1000 at an angle "B" to avoid damaging the gutter.

Narrow section 1200N includes at least one transverse opening 1280 extending from the top surface 1210 to the bottom surface 1270. Preferably, there are two spaced apart openings 1280 and 1282 extending through the entire thickness of narrow section 1200N from top surface 1210 to bottom surface 1270. An affixing member such as nail 1284 is hammered through opening 1280 into the top surface 510 of parapet roof wall 500. In addition, a second affixing member such as nail 1286 is hammered through opening 1282 into top surface 510 of parapet roof wall 500. Depending on how far it is desired for front edge 266 and arms 262 and 264 to extend beyond front side wall 520, the piano hinge connecting pin can be at the rear edge 530-RE of parapet roof wall 500 so that wide section 1100 hangs down adjacent rear surface wall 540 of the parapet roof wall 500.

Wide section 1100 includes at least one transverse opening 1180 extending from the top surface 1110 to the bottom surface 1170. Preferably, there are two spaced apart openings 1180 and 1182 extending through the entire thickness of wide section 1100 from the top surface 1110 to the bottom surface 1170. An affixing member such as nail 1184 is hammered through opening 1180 into the rear surface wall 540 of parapet roof wall 500. In addition, a second affixing member such as nail 1186 is hammered through opening 1182 into the rear surface wall 540 of parapet roof wall 500. This is a preferred embodiment.

If it is desired to have less extension of front edge wall 1266 and arms 1262 and 1264 to extend in front of parapet front wall 510, then the hinges are further away and behind rear edge 530 of parapet roof wall 500. The bottom surface 1270 lies flat against top wall 510 of parapet roof wall 500.

As additional security, a ladder step fastening member 1200 such as a strong rope, chain, bungee cord, etc. is wrapped through front central opening 190 of wide section 100 and wrapped around at least one step or rung 1100 of extension ladder 1000 to prevent the ladder from falling away from the ladder support device wide section 1100. Preferably, the ladder step fastening member 1200 includes several wraps around both the front central opening 190 and step or rung 1100 of extension ladder 1000.

As illustrated in FIG. 10A, the feet 2300A and 2300B of ladder 1001 rest on a horizontal ground surface 2500 so that ladder 1001 is at an angle "B" of seventy-five degrees relative to top surface wall 510 of parapet roof wall 500. By way of example, ladder 1001 has a height or length LH-2 of 16 feet and a distance from the feet of the ladder to the front wall of the parapet roof LD-2 of four feet. Therefore, the angle of seventy-five degrees is the equivalent of the distance from the feet of the ladder to the front wall of the parapet roof being one-quarter the height of the ladder. The angle is required in order to avoid damaging a gutter 3000 which runs along the front surface wall 520 adjacent top surface wall 510 of parapet of wall 500.

In addition to the ladder having an angle of seventy-five degrees, the equivalent is measuring the distance of the feet of the ladder on the ground to the front wall and the height of the ladder and the distance from the feet on the ground to the front wall should be one-quarter the height of the ladder. By way of example, if the ladder is twelve feet tall, then that distance is three feet. If the ladder is ten feet tall, then the distance is 2.5 feet. If the ladder is 16 feet tall, then the distance is four feet. The equivalent is also true for any other height ladder.

As additional security, a ladder step fastening member 11200 such as a strong rope, chain, bungee cord, etc. is wrapped through front central opening 1290 in narrow section 1200N and wrapped around at least one step or rung 12100 of ladder 1000 to prevent the ladder from falling away from the ladder support device narrow section 1200N.

Preferably, the ladder step fastening member 11200 includes several wraps around both the front central opening 1290 and step or rung 12100 of ladder 1000. As illustrated in FIG. 10A, the feet 2300A and 2300B of ladder 1000 rest on a horizontal ground surface 2500 so that ladder 1000 is at an angle "B" being seventy-five degrees relative to top surface wall 510 of parapet roof wall 500 wherein seventy-five degree is the equivalent of the distance from the base of the ladder to the parapet roof wall being one-quarter the height of the ladder. The angle is required in order to avoid damaging a gutter 3000 which runs along the front surface wall 520 adjacent top surface wall 510 of parapet of wall 500.

In addition to having a double wide different width ladder safety device 1010 and providing security to extension ladder 1000 resting on a ground surface at one end and extending above the present invention ladder safety device and resting against front wall 1166 of wide section 1100 and providing security to ladder 1000 resting on a ground surface at one end and extending above the present invention ladder safety device and resting against front wall 1266 of narrow section 1200N, the present invention is also used to support a smaller ladder to enable a worker to climb out of a deep parapet roof. In general, the parapet roof may only be one or two feet deep. A worker must then jump over the parapet top wall and land on the top surface of a ladder safety device and rely of the diamond plate to be sure the worker's boots grip the diamond plate as a worker climbs onto the ladder 1000 or extension ladder 2000.

With the present invention design, the ladder safety device can be used to support two ladders, the main safety ladder from the ground to the ladder safety device and a smaller ladder from the roof to the ladder safety device. so that a small ladder can be anchored to the interior surface of the roof and retained against the front surface and between the arms to safely climb out of a deeper parapet roof and onto the surface with the diamond plates. This can be accomplished in the following way.

Figure 11:
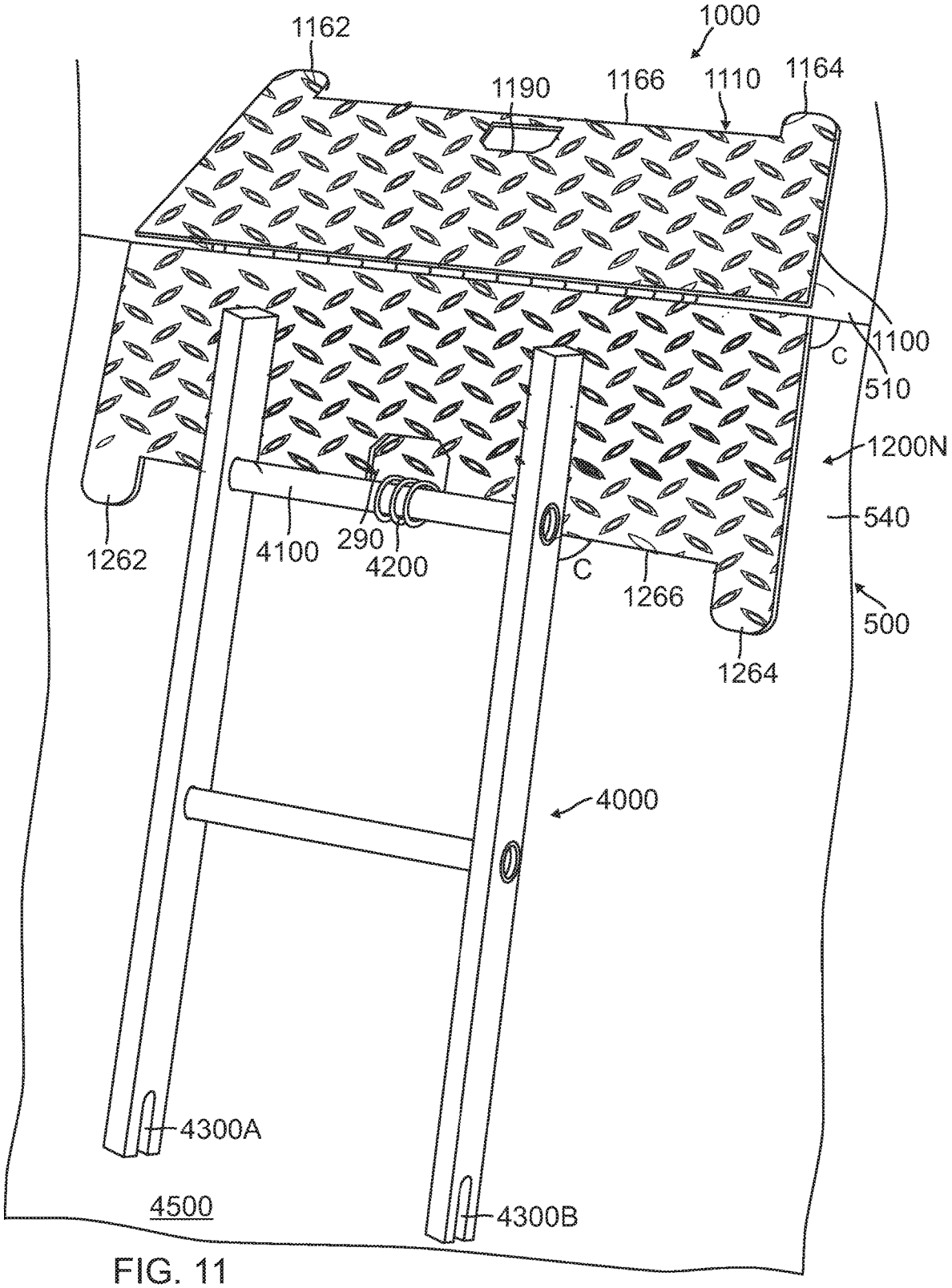
FIG. 11 is a rear front and side perspective view of the embodiment of the present invention ladder safety support device illustrated in FIG. 7, FIG. 8 and FIG. 9 including a piano hinge and Durbar floor plate surfaces, with the device installed with the wide section affixed to the top surface of the parapet wall and extending forward of the front side of the parapet wall (the front extension ladder between the ladder safety device not illustrated for visual clarity) and a small ladder (either a step ladder or a small ladder between two feet and six feet) on the interior roof and tied to a portion of the narrow section extending at an angle relative to the interior surface of the parapet wall and tied to the opening of the narrow section.

Referring to FIG. 11, a worker takes the ladder safety device 1010 and affixes one section such as the wide section 1100 to the top surface wall 510 of the parapet roof wall 500 to retain the ladder 1000 from the ground to the front wall 1166 between arms 1162 and 1164 and secured with a rope 1200 wrapped around one ladder step 1100 and ladder securing opening 1190 as previously described. With the second narrow section 1200N, instead of letting it hang down or nailed to the back of the back surface wall 540 of the parapet roof wall 500, the second section 1200N extends either in line with first section 1100 or at a slight angle "C" relative to rear surface wall 540. A small step ladder 4000 or small ladder is positioned so that its feet 4300A and 4300B rest on horizontal interior roof surface 4500 and the small adder 4000 is positioned against the front wall 1266 between arms 1262 and 1264 and retained with a rope or chain 4200 wrapped around a step or rung 4100 of the ladder 4000 and ladder securing opening 1290 in the narrow section 1200N. Preferably, there are several wrappings around both step or rung 4100 and ladder securing opening 1290. The worker then climbs up small ladder 4000 and onto top surface 1110 of wide section 1100 and onto ladder 1000.

Referring to FIG. 11, a worker takes the ladder safety device 1010 and affixes one section such as the wide section 1100 to the top surface wall 510 of the parapet roof wall 500 to retain the ladder 1000 from the ground to the front wall 1166 between arms 1162 and 1164 and secured with a rope 1200 wrapped around one ladder step 1100 and ladder securing opening 1190 as previously described. With the second narrow section 1200N, instead of letting it hang down or nailed to the back of the back surface wall 540 of the parapet roof wall 500, the second section 1200N extends either in line with first section 100 or at a slight angle "C" relative to rear surface wall 540. A small step ladder 4000 or small ladder is positioned so that its feet 4300A and 4300B rest on horizontal interior roof surface 4500 and the small adder 4000 is positioned against the front wall 1266 between arms 1262 and 1264 and retained with a rope or chain 4200 wrapped around a step or rung 4100 of the ladder 4000 and ladder securing opening 1290 in the narrow section 1200N. Preferably, there are several wrappings around both step or rung 4100 and ladder securing opening 1290. The worker then climbs up small extension ladder 4000 and onto top surface 1110 of wide section 1100 and onto extension ladder 1000.

Figure 12:
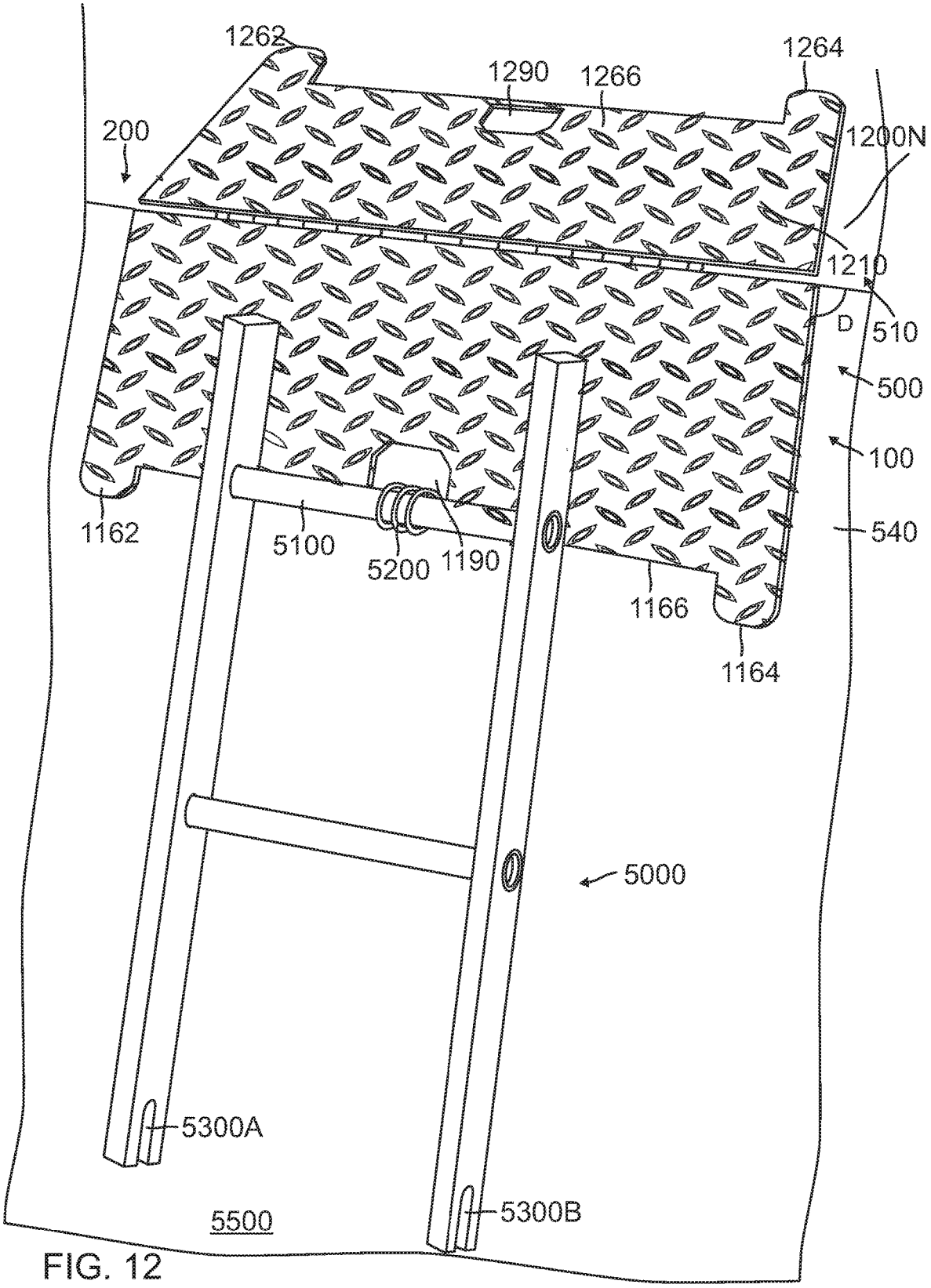
FIG. 12 is a rear front and side perspective view of the embodiment of the present invention ladder safety support device illustrated in FIG. 7, FIG. 8 and FIG. 9 including a piano hinge and Durbar floor plate surfaces, with the device installed with the narrow section affixed to the top surface of the parapet wall and extending forward of the front side of the parapet wall (the front extension ladder between the ladder safety device not illustrated for visual clarity) and a small ladder (either a step ladder or a small ladder between two feet and six feet) on the interior roof and tied to a portion of the wide section extending at an angle relative to the interior surface of the parapet wall and tied to the opening of the wide section.

Referring to FIG. 12, there is illustrated a view of the embodiment of the present invention ladder safety support device illustrated in FIGS. 7, 8 and 10 including a piano hinge and Durbar floor plate surface, with the device installed with the narrow section affixed to the top surface of the parapet wall and extending forward of the front side of the parapet wall (the front extension ladder between the ladder safety device not illustrated for visual clarity) and a small ladder (either a step ladder or a small ladder between two feet and six feet) on the interior roof and tied to a portion of the wide section extending at an angle relative to the interior surface of the parapet wall and tied to the opening of the wide section.

It is also within the spirit and scope of the present invention to use the same concept with the ladder support safety device 1010 as illustrated in FIG. 10. Referring to FIG. 12, a worker takes the ladder safety device 1010 and affixes one section such as the narrow section 1200N to the top surface wall 510 of the parapet roof wall 500 to retain the ladder 1000 from the ground to the front wall 1266 between arms 1262 and 1264 and secured with a rope 2200 wrapped around one ladder step or rung 2100 and ladder securing opening 1290 as previously described.

The present invention incorporates the following combinations:

(1) PIANO HINGE 1238 AFFIXED TO THE COMBINATION WIDE SECTION DIAMOND PLATE 100 MADE OF MATERIAL SELECTED FROM THE GROUP CONSISTING OF DIAMOND PLATE ALUMINUM, DIAMOND PLATE STEEL, DIAMOND PLATE ABS PLASTIC, DIAMOND PLATE POLYETHYLENE AND DIAMOND PLATE HARD PLASTIC; AND NARROW SECTION DIAMOND PLATE 200 MADE OF MATERIAL SELECTED FROM THE GROUP CONSISTING OF DIAMOND PLATE ALUMINUM, DIAMOND PLATE STEEL, DIAMOND PLATE ABS PLASTIC, DIAMOND PLATE POLYETHYLENE AND DIAMOND PLATE HARD PLASTIC;

(2) PIANO HINGE 1238 AFFIXED TO THE COMBINATION WIDE SECTION DURBAR FLOOR PLATE 1100 MADE OF MATERIAL SELECTED FROM THE GROUP CONSISTING OF DURBAR FLOOR PLATE ALUMINUM, DURBAR FLOOR PLATE STEEL, DURBAR FLOOR PLATE ABS PLASTIC, DURBAR FLOOR PLATE POLYETHYLENE AND DURBAR FLOOR PLATE HARD PLASTIC; AND NARROW SECTION DURBAR FLOOR PLATE 1200N MADE OF MATERIAL SELECTED FROM

THE GROUP CONSISTING OF DURBAR FLOOR PLATE ALUMINUM, DURBAR FLOOR PLATE STEEL, DURBAR FLOOR PLATE ABS PLASTIC, DURBAR FLOOR PLATE POLYETHYLENE AND DURBAR FLOOR PLATE HARD PLASTIC;

(3) PAIR OF DOOR HINGES 126, 236, 139 AND 138, 238 and 239 AFFIXED TO THE COMBINATION WIDE SECTION DIAMOND PLATE 100 MADE OF MATERIAL SELECTED FROM THE GROUP CONSISTING OF DIAMOND PLATE ALUMINUM, DIAMOND PLATE STEEL, DIAMOND PLATE ABS PLASTIC, DIAMOND PLATE POLYETHYLENE AND DIAMOND PLATE HARD PLASTIC;

(4) PAIR OF DOOR HINGES 126, 236 139 AND 138, 239 AND WIDE SECTION 1100 MADE OF MATERIAL SELECTED FROM THE GROUP CONSISTING OF DURBAR FLOOR PLATE ALUMINUM, DURBAR FLOOR PLATE STEEL, DURBAR FLOOR PLATE ABS PLASTIC, DURBAR FLOOR PLATE POLYETHYLENE AND DURBAR FLOOR PLATE HARD PLASTIC, AND NARROW SECTION 1200N MADE OF MATERIAL SELECTED FROM THE GROUP CONSISTING OF DURBAR FLOOR PLATE ALUMINUM, DURBAR FLOOR PLATE STEEL, DURBAR FLOOR PLATE ABS PLASTIC, DURBAR FLOOR PLATE POLYETHYLENE AND DURBAR FLOOR PLATE HARD PLASTIC.

Figure 13:
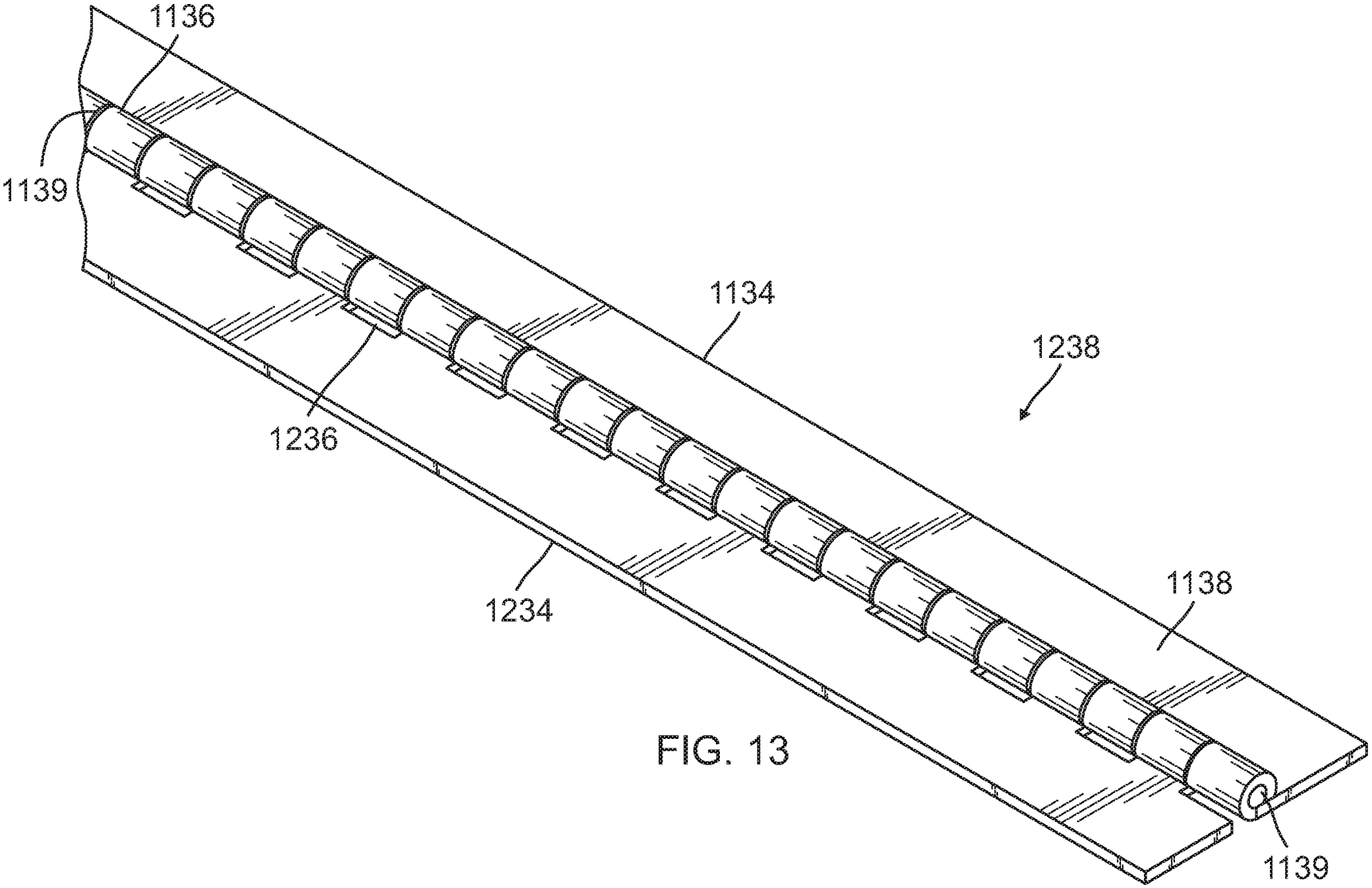
FIG. 13 is a top plan view of a piano hinge.

Referring to FIG. 13, there is illustrated a top plan view of a piano hinge 1238.

Figure 14:
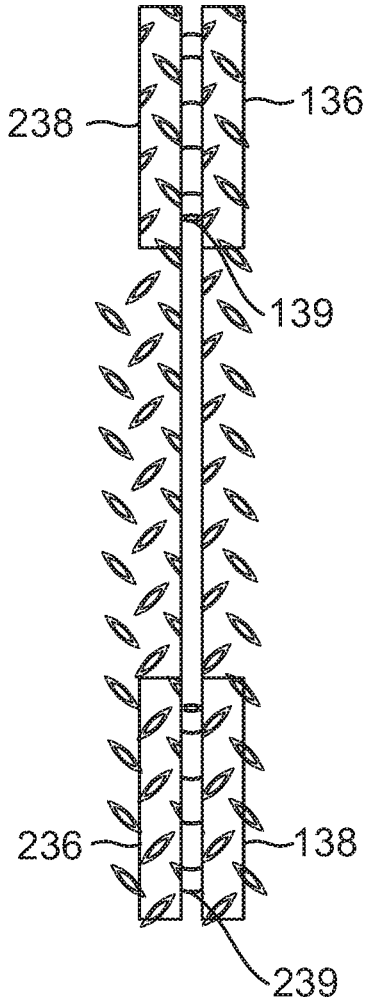
FIG. 14 is a top plan view of a door hinge.

Referring to FIG. 14, there is illustrated a top plan view of a pair of door hinges 126, 236 139 and 128, 238 239.

Figure 15:
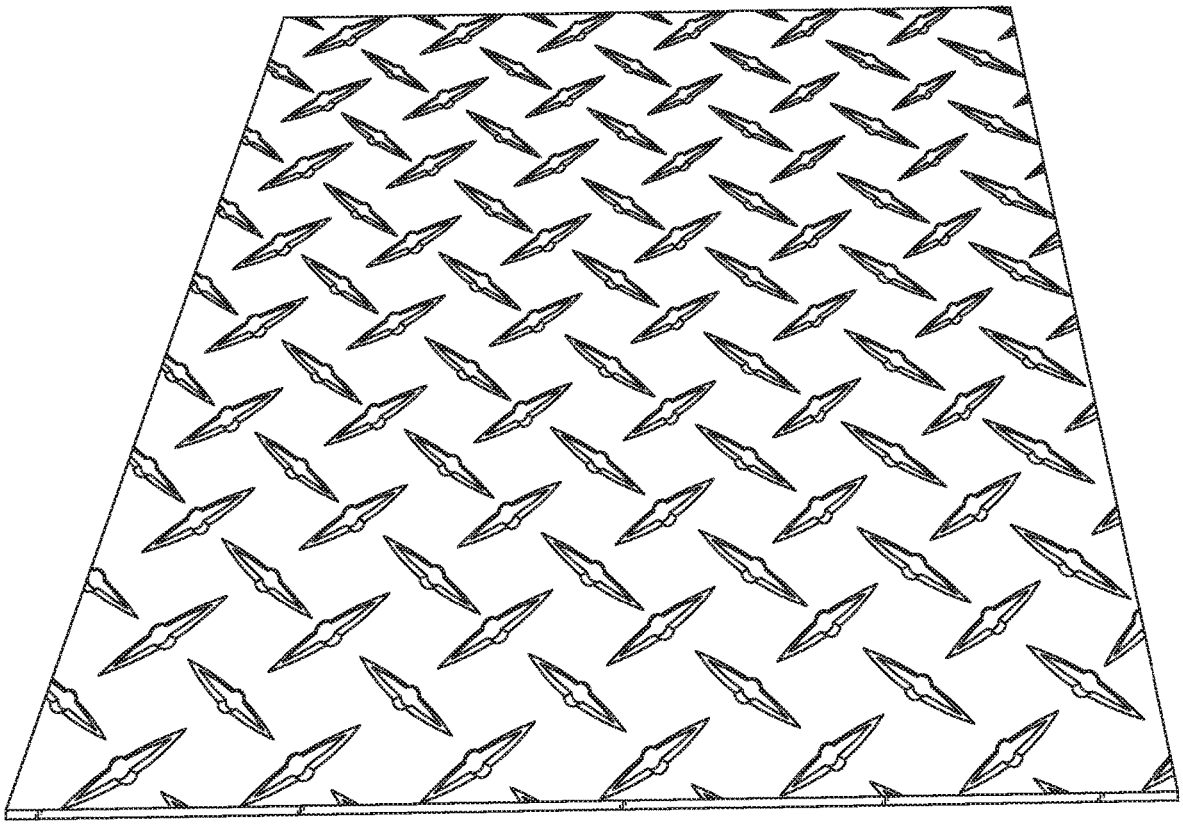
FIG. 15 is a top plan view of a diamond plate surface.

Referring to FIG. 15, there is illustrated a top plan view of a diamond plate surface.

Figure 16:
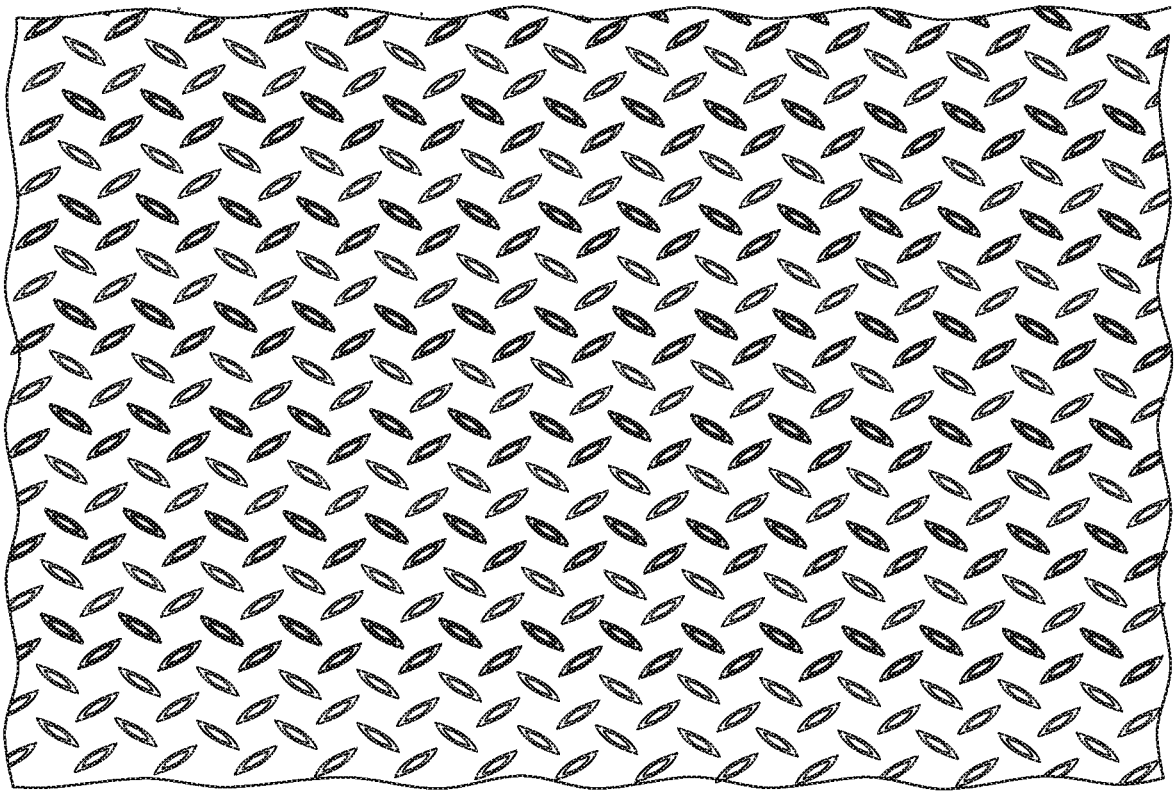
FIG. 16 is a top plan view of a Durbar floor plate surface.

Referring to FIG. 16, there is illustrated a top plan view of a Durbar floor plate surface.

Figure 17:
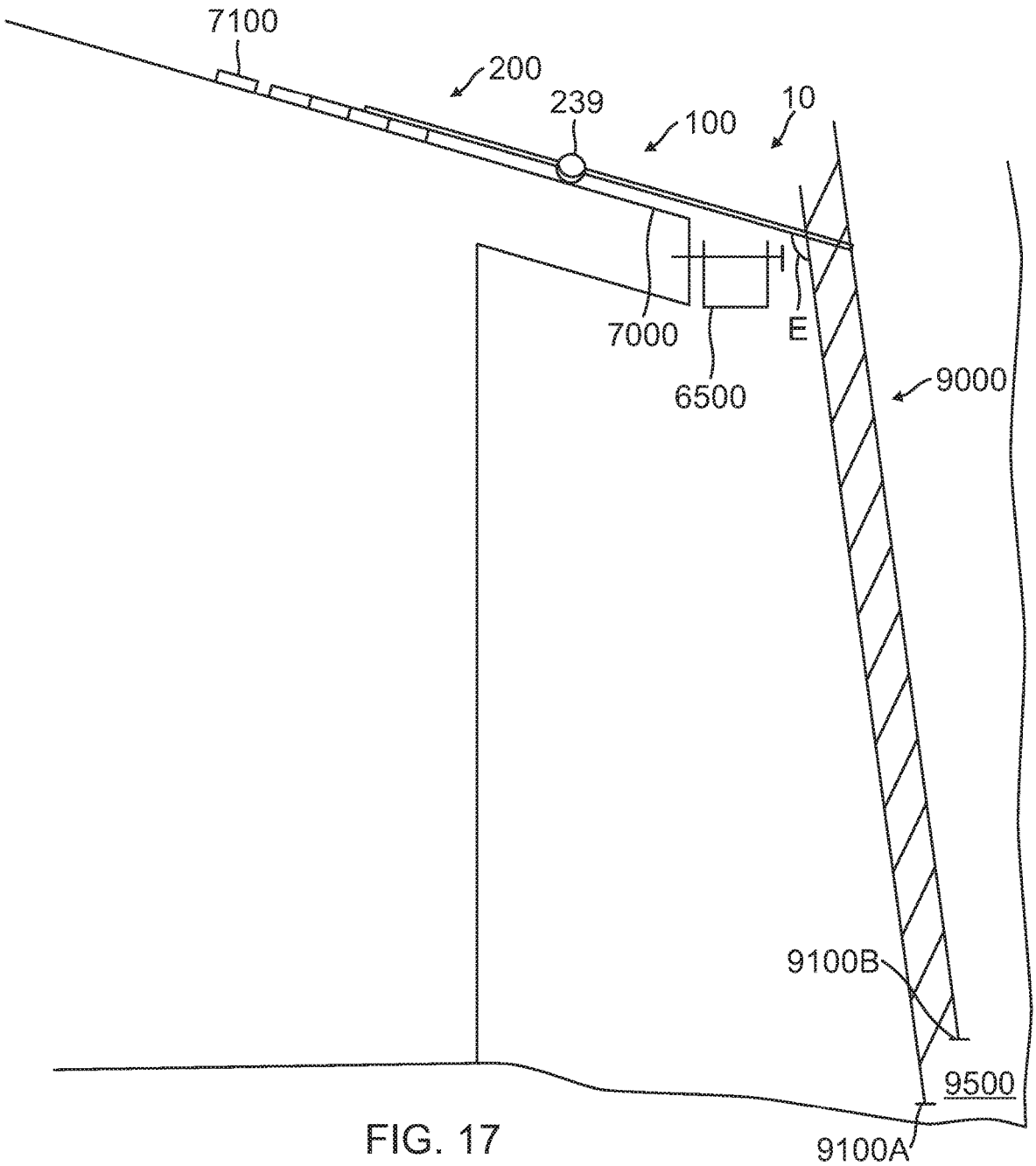
FIG. 17 is a side perspective view of the embodiment of the present invention ladder safety support device illustrated in FIG. 1 and FIG. 2 hammered to a roof with shingles and supporting an extension ladder.

Referring to FIG. 17, there is illustrated a side perspective view of the embodiment of the present invention ladder safety support device 10 illustrated in FIG. 1 and FIG. 2 hammered to a roof with shingles and supporting an extension ladder. Both the wide section 100 and narrow section 200 are hammered into shingles 7100 through affixing members such as at least one and preferably two, nails hammered into the shingles. The wide section preferably extends away from roof 7000 to support extension ladder 9000 in the manner previously described for the first embodiment. The extension ladder 9000 is at an angle "E"

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A safety ladder device support apparatus comprising:

(a) a wide section having a first body with a first end and a second end, the first body including a first top surface and a first bottom surface, the first body made of material selected from the group consisting of diamond plate aluminum, diamond plate steel, diamond plate ABS plastic, diamond plate polyethylene, diamond plate hard plastic, Durbar floor plate aluminum, Durbar floor plate steel, Durbar floor plate ABS plastic, Durbar floor plate polyethylene and Durbar floor plate hard plastic, the first top surface including a multiplicity of protrusions, a first back edge extending from the first end to the second end, a first side edge at the first end and perpendicular to the first back edge, a second side edge at the second end and perpendicular to the back edge, two laterally spaced apart forwardly extending arms extending from a first front edge including a first arm aligned along the first side edge and a second arm aligned along the second side edge the first arm and the second arm forming an open U shape portion extending past said first front edge, and an opening extending from the first top surface to the bottom surface and located adjacent to and separated from said first front edge and at a location behind said first front edge and between the first side edge and the second side edge, a plurality of affixing openings in the first body extending from the first top surface to the first bottom surface and located behind said first front edge;

(b) a narrow section having a second body with a third end and a fourth end, the second body including a second top surface and a second bottom surface, the second body made of material selected from the group consisting of diamond plate aluminum, diamond plate steel, diamond plate ABS plastic, diamond plate polyethylene, diamond plate hard plastic, Durbar floor plate aluminum, Durbar floor plate steel, Durbar floor plate ABS plastic, Durbar floor plate polyethylene and Durbar floor plate hard plastic, the second top surface including a multiplicity of protrusions, a second back edge extending from the third end to the fourth end, a third side edge at the third end and perpendicular to the second back edge, a fourth side edge at the fourth end and perpendicular to the back edge, two laterally spaced apart rearwardly extending arms extending from a second front edge including a third arm aligned along the third side edge and a fourth arm aligned along the fourth side edge, the third arm and the fourth arm forming an open U shape portion extending past said second front edge, and an opening extending from the second top surface to the second bottom surface and located adjacent to and separated from said second front edge and at a location behind said second front edge between the third side edge and the fourth side edge, a plurality of affixing openings in the second body extending from the second top surface to the second bottom surface and behind said second front edge;

(c) a first back end of first wide section aligned with a second back end of a second narrow section with a gap between the first back end and the second back end, the first side edge aligned with the fourth side edge and the second side edge aligned with the third side edge, a first wide section rotatably connected to the second narrow section by a hinge assembly affixed to the first wide section and the second narrow section; and (d) a plurality of affixing members wherein an individual affixing member is inserted into each of the plurality of affixing openings in the first body and the second body.

2. The safety ladder device support apparatus in accordance with claim 1, further comprising:

(a) the hinge assembly is selected from the group consisting of a piano hinge and a pair of spaced apart door hinges;

(b) the piano hinge including:

(i) a first longitudinal mounting plate affixed to the first wide section adjacent the first back edge and retaining a first half of a piano hinge bracket extending into the gap, (ii) a second longitudinal mounting plate affixed to the second narrow section adjacent the second back edge and retaining a second half of a piano hinge bracket extending into the gap and offset from the first half of the piano hinge bracket, (iii) a first piano hinge connecting pin supported by the first half of the piano hinge bracket and the second half of the piano hinge bracket; and (c) the spaced apart pair of door hinges including:

(i) a first door hinge bracket including a first hinge bracket affixed to the first wide section adjacent the first back edge and a fourth hinge bracket affixed to the second narrow section adjacent the second back edge and a first connecting pin supported by the first hinge bracket and the fourth hinge bracket, the first connecting pin located in the gap between the first back edge and the second back edge, and (ii) a spaced apart second door hinge bracket including a second hinge bracket affixed to the first wide section adjacent the first back edge and a third hinge bracket affixed to the second narrow section adjacent the second back edge and a second connecting pin supported by the second hinge bracket and the third hinge bracket, the second connecting pin located in the gap between the first back edge and the second back edge, and (iii) the first door hinge located closer to the first side edge and the fourth side edge than the second door hinge located closer to the second side edge and the third side edge.

3. A safety ladder device support apparatus comprising:

(a) a wide section having a first body with a first end and a second end, the first body including a first top surface having projections selected from the group consisting of diamond projections and Durbar floor plate projections, and a first bottom surface, a first back edge extending from the first end to the second end, a first side edge at the first end and perpendicular to the first back edge, a second side edge at the second end and perpendicular to the back edge, a front open U-shaped portion extending from a first front edge with two laterally spaced apart forwardly extending arms including a first arm aligned along the first side edge and a second arm aligned along the second side edge, said first front edge between the first arm and the second arm, and an opening extending from the first top surface to the bottom surface and located adjacent to and separated from said first front edge and at a location between the first side edge and the second side edge, at least one affixing opening in the first body extending from the first top surface to the first bottom surface and formed behind said first front edge;

(b) a narrow section having a second body with a third end and a fourth end, the second body including a second top surface having projections selected from the group consisting of diamond projections and Durbar floor plate projections and a second bottom surface, a second back edge extending from the third end to the fourth end, a third side edge at the third end and perpendicular to the second back edge, a fourth side edge at the fourth end and perpendicular to the back edge, a rear open U-shaped portion extending from a second front edge with two laterally spaced apart rearwardly extending arms including a third arm aligned along the third side edge and a fourth arm aligned along the fourth side edge, said second front edge between the third arm and the fourth arm, and an opening extending from the second top surface to the second bottom surface and located adjacent to and separated from said second front edge and at a location between the third side edge and the fourth side edge and at least one affixing opening in the second body extending from the second top surface to the second bottom surface and located behind said second front edge;

(c) a first back end of first wide section aligned with a second back end of a second narrow section with a gap between the first back end and the second back end, the first side edge aligned with the fourth side edge and the second side edge aligned with the third side edge, a first wide section rotatably connected to the second narrow section by a hinge assembly affixed to the first wide section and the second narrow section; and (d) a plurality of affixing members, wherein an individual affixing member is positioned within each of said at least one affixing opening in the first body and said at least one affixing opening said second body.

4. The safety ladder device support apparatus in accordance with claim 3, further comprising:

(a) the hinge assembly is selected from the group consisting of a piano hinge and a pair of spaced apart door hinges;

(b) the piano hinge including:

(i) a first longitudinal mounting plate affixed to the first wide section adjacent the first back edge and retaining a first half of a piano hinge bracket extending into the gap, (ii) a second longitudinal mounting plate affixed to the second narrow section adjacent the second back edge and retaining a second half of a piano hinge bracket extending into the gap and offset from the first half of the piano hinge bracket, (iii) a first piano hinge connecting pin supported by the first half of the piano hinge bracket and the second half of the piano hinge bracket;

(c) the spaced apart pair of door hinges including:

(i) a first door hinge bracket including a first hinge bracket affixed to the first wide section adjacent the first back edge and a fourth hinge bracket affixed to the second narrow section adjacent the second back edge and a first connecting pin supported by the first hinge bracket and the fourth hinge bracket, the second connecting pin located in the gap between the first back edge and the second back edge, (ii) a spaced apart second door hinge bracket including a second hinge bracket affixed to the first wide section adjacent the first back edge and a third hinge bracket affixed to the second narrow section adjacent the second back edge and a second connecting pin supported by the second hinge bracket and the third hinge bracket, the second connecting pin located in the gap between the first back edge and the second back edge, and (iii) the first door hinge located closer to the first side edge and the fourth side edge than the second door hinge and the second door hinge located closer to the second side edge and the third side edge than the first door hinge.

5. The safety ladder device support apparatus in accordance with claim 4, further comprising:

(a) the first body of the first wide section is made of material selected from the group consisting of diamond plate aluminum, diamond plate steel, diamond plate ABS plastic, diamond plate polyethylene, diamond plate hard plastic, Durbar floor plate aluminum, Durbar floor plate steel, Durbar floor plate ABS plastic, Durbar floor plate polyethylene and Durbar floor plate hard plastic; and (b) the second body of the second narrow section is made of material selected from the group consisting of diamond plate aluminum, diamond plate steel, diamond plate ABS plastic, diamond plate polyethylene, diamond plate hard plastic, Durbar floor plate aluminum, Durbar floor plate steel, Durbar floor plate ABS plastic, Durbar floor plate polyethylene and Durbar floor plate hard plastic.

* * * * *